US006126784A

United States Patent [19]

Ficke et al.

[11] Patent Number: 6,126,784

[45] Date of Patent: Oct. 3, 2000

[54] PROCESS FOR APPLYING CHEMICAL PAPERMAKING ADDITIVES TO WEB SUBSTRATE

[75] Inventors: Jonathan Andrew Ficke, Lawrenceburg, Ind.; Kenneth Douglas Vinson, Cincinnati, Ohio

[73] Assignee: The Procter & Gamble Company, Cincinnati, Ohio

[21] Appl. No.: 09/305,765

[22] Filed: May 5, 1999

[51] Int. Cl.[7] ..... D21H 23/22

[52] U.S. Cl. ..... 162/184; 162/158; 162/135; 162/183; 162/111; 162/164.3; 162/164.1; 162/164.6; 162/168.1; 162/168.2

[58] Field of Search ..... 162/111, 112, 162/113, 135, 136, 158, 206–207, 164.1–164.3, 168.1–168.6, 183, 184, 185, 179; 156/183; 264/282–283; 428/211, 152–154

[56] References Cited

U.S. PATENT DOCUMENTS

| | | |
|---|---|---|
| H1672 | 8/1997 | Hermans et al. . |
| 4,300,981 | 11/1981 | Carstens . |
| 4,874,465 | 10/1989 | Cochrane et al. . |
| 5,059,282 | 10/1991 | Ampulski et al. . |
| 5,215,626 | 6/1993 | Ampulski et al. . |
| 5,228,954 | 7/1993 | Vinson et al. . |
| 5,246,545 | 9/1993 | Ampulski et al. . |
| 5,264,082 | 11/1993 | Phan et al. . |
| 5,405,499 | 4/1995 | Vinson . |
| 5,487,813 | 1/1996 | Vinson et al. . |
| 5,525,345 | 6/1996 | Warner et al. . |
| 5,840,403 | 11/1998 | Trokhan et al. . |

*Primary Examiner*—Stanley S. Silverman
*Assistant Examiner*—José A. Fortuna
*Attorney, Agent, or Firm*—Vladimir Vitenberg; Larry L. Huston; Donald E. Hasse

[57] ABSTRACT

A process for applying a chemical additive, such as a softener, to a fibrous web comprises the steps of: providing a fibrous web having a first side and a second side opposite to the first side; providing a chemical additive; depositing the chemical additive only to the first side of the fibrous web; causing the first side of the fibrous web to contact the second side of the fibrous web thereby partially transferring the chemical additive from the first side to the second side of the fibrous web such that both the first side and the second side of the fibrous web comprise the chemical additive in a functionally sufficient amount. Preferably, the step of causing the two sides of the web to contact comprises winding the web into a roll.

25 Claims, 4 Drawing Sheets

PROCESS FOR APPLYING CHEMICAL PAPERMAKING ADDITIVES TO WEB SUBSTRATE

TECHNICAL FIELD

This invention relates, in general, to web substrate, such as tissue paper, and a process for preparing the web substrate. More specifically, the invention is concerned with web substrate having chemical functional additives and a process and apparatus for applying low levels of chemical functional additives to a surface of the web substrate for enhancing the properties of the web, e. g., strength, softness, absorbency, and aesthetics.

BACKGROUND OF THE INVENTION

Disposable paper products are widely used. Disposable consumer items, made from cellulosic fibers, are commercially offered in formats tailored for a variety of uses, such as, for example, facial tissues, toilet paper, absorbent towels, diapers, etc.

All of these sanitary products share a common need, specifically—to be soft to the touch. Softness is a complex tactile impression evoked by a product when it is stroked against the skin. The purpose of being soft is so that these products can be used to cleanse the skin without being irritating. Effectively cleansing the skin is a persistent personal hygiene problem for many people. Objectionable discharges of urine, menses, and fecal matter from the perineal area or otorhinolaryngogical mucus discharges do not always occur at a time convenient for one to perform a thorough cleansing, as with soap and copious amounts of water for example. As a substitute for thorough cleansing, a wide variety of tissue and toweling products are offered to aid in the task of removing from the skin and retaining such discharges for disposal in a sanitary fashion. Not surprisingly, the use of these products does not approach the level of cleanliness that can be achieved by the more thorough cleansing methods, and producers of tissue and toweling products are constantly striving to make their products compete more favorably with thorough cleansing methods.

Shortcomings in tissue products for example cause many to stop cleaning before the skin is completely cleansed. Such behavior is prompted by the harshness of the tissue, as continued rubbing with a harsh implement can abrade the sensitive skin and cause severe pain. The alternative, leaving the skin partially cleansed, is chosen even though this often causes malodors to emanate and can cause staining of undergarments, and over time can cause skin irritations as well.

Disorders of the anus, for example hemorrhoids, render the perianal area extremely sensitive and cause those who suffer such disorders to be particularly frustrated by the need to clean their anus without prompting irritation.

Another notable case which prompts frustration is the repeated nose blowing necessary when one has a cold. Repeated cycles of blowing and wiping can culminate in a sore nose even when the softest tissues available today are employed.

Accordingly, making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area that has been explored in this regard has been to select and modify cellulose fiber morphologies and engineer paper structures to take optimum advantages of the various available morphologies. Applicable art in this area includes: Vinson et. al. in U.S. Pat. Nos. 5,228,954, issued Jul. 20, 1993, Vinson in 5,405,499, issued Apr. 11, 1995, Cochrane et al. in 4,874,465 issued Oct. 17, 1989, and Hermans, et. al. in U. S. Statutory Invention Registration H1672, published on Aug. 5, 1997, all of which disclose methods for selecting or upgrading fiber sources to tissue and toweling of superior properties. Applicable art is further illustrated by Carstens in U.S. Pat. No. 4,300,981, issued Nov. 17, 1981, which discusses how fibers can be incorporated to be compliant to paper structures so that they have maximum softness potential. While such techniques as illustrated by these prior art examples are recognized broadly, they can only offer some limited potential to make tissues truly effective comfortable cleaning implements.

Another area which has received a considerable amount of attention is the addition of a chemical softening agent (also referred to herein as "chemical softener" or "softening composition" and permutation thereof) to tissue and toweling products. As used herein, the term "chemical softening agent" refers to any chemical ingredient which improves the tactile sensation perceived by the consumer who holds a particular paper product and rubs it across the skin. Desirable for towel products, softness is a particularly important property for facial and toilet tissues. Such tactilely perceivable softness can be characterized by, but is not limited to, friction, flexibility, and smoothness, as well as subjective descriptors, such as a feeling like lubricious, velvet, silk or flannel. Suitable materials include those which impart a lubricious feel to tissue. This includes, for exemplary purposes only, basic waxes such as paraffin and beeswax and oils such as mineral oil and silicone oil as well as petrolatum and more complex lubricants and emollients such as quaternary ammonium compounds with long alkyl chains, functional silicones, fatty acids, fatty alcohols and fatty esters.

The field of work in the prior art pertaining to chemical softeners has taken two paths. The first path is characterized by the addition of softeners to the tissue paper web during its formation either by adding an attractive ingredient to the vats of pulp which will ultimately be formed into a tissue paper web, to the pulp slurry as it approaches a paper making machine, or to the wet web as it resides on a Fourdrinier cloth or dryer cloth on a paper making machine. The second path is categorized by the addition of chemical softeners to tissue paper web after the web is dried. In the latter instance, typically the softener is applied to one or both sides of the tissue paper. Applicable processes can be incorporated into the paper making operation as, for example, by spraying onto the dry web before it is wound into a roll of paper.

Exemplary art related to the former path categorized by adding chemical softeners to the tissue paper prior to its assembly into a web includes commonly assigned U.S. Pat. No. 5,264,082, issued to Phan and Trokhan on Nov. 23, 1993, which patent is incorporated herein by reference. Such methods have found broad use in the industry especially when it is desirable to reduce the strength which would otherwise be present in the paper, and when the papermaking process (particularly one having a creping operation) is robust enough to tolerate incorporation of the bond inhibiting agents. However, there are problems associated with these methods, well known to those skilled in the art. First, the location of the chemical softener is not controlled; it is spread as broadly through the paper structure as the fiber furnish to which it is applied. In addition, there is a loss of paper strength accompanying use of these additives. While not being bound by theory, applicants believe that the additives tend to inhibit the formation of fiber to fiber hydrogen bonds. There also can be a loss of control of the sheet as it is creped from the Yankee dryer. Again, a widely believed theory is that the additives interfere with the coating on the Yankee dryer so that the bond between the wet web and the dryer is weakened. Prior art such as commonly assigned U.S. Pat. No. 5,487,813, issued to Vinson, et. al., Jan. 30, 1996, incorporated herein by reference, discloses inclusion of a chemical combination to mitigate the before-mentioned effects on strength and adhesion to the creping cylinder; however, there still remains a need to incorporate a chemical softener into a paper web in a targeted fashion with minimal adverse effect on web strength and minimal interference with the production process.

Further exemplary art related to the addition of chemical softeners to the tissue paper web during its formation includes commonly assigned U.S. Pat. No. 5,059,282, issued to Ampulski, et. al. on Oct. 22, 1991 incorporated herein by reference. The Ampulski patent discloses a process for adding a polysiloxane compound to a wet tissue web (preferably at a fiber consistency between about 20% and about 35%). Such a method represents an advance in some respects over the addition of chemicals into the slurry vats supplying the papermaking machine. For example, such means target the application to one of the web surfaces as opposed to distributing the additive onto all of the fibers of the furnish.

Because of the before-mentioned effects on strength and disruption of the papermaking process, considerable art has been devised to apply chemical softeners to already-dried paper webs either at the so-called dry end of the papermaking machine or in a separate converting operation subsequent to the papermaking step. Exemplary art from this field includes U.S. Pat. Nos. 5,215,626, issued to Ampulski, et. al. on Jun. 1, 1993; 5,246,545, issued to Ampulski, et. al. on Sep. 21, 1993; 5,525,345, issued to Warner, et. al. on Jun. 11, 1996, and U.S. patent application Ser. No. 09/053,319 filed in the name of Vinson, et al. on Apr. 1, 1998 all incorporated herein by reference. While each of these references represent advances over the previous so-called wet end methods particularly with regard to eliminating the degrading effects on the papermaking process, the processes typically require that the softening application occur simultaneously with compression of the web. Along with the loss of thickness of the tissue paper web, which can be an issue, these methods of application do not allow effective application of softener to the outermost elevations of the tissue paper web, when multi-region tissue webs having multiple elevations is employed. The before mentioned application processes also do not yield proud deposits, i.e. deposits which extend above the outermost elevation of the tissue paper web. This is essential for the before-mentioned processes because proud deposits tend to be removed from the web onto machine surfaces causing processing problems due to transfer of the softeners. If proud deposits could be applied without these transfer and build-up issues, it would be advantageous because transfer could thereby be encouraged from one surface of a tissue paper web to the second surface of the web, permitting in effect a two-sided surface softened tissue paper web, while only actively applying the surface softener to one side.

One of the most important physical properties related to softness is generally considered by those skilled in the art to be the strength of the web. Strength is the ability of the product, and its constituent webs, to maintain physical integrity and to resist tearing, bursting, and shredding under use conditions. Achieving high softness without degrading strength has long been recognized as a means of providing improved tissue products. There is a continuing need for soft tissue paper products having good strength properties.

Accordingly, there is a need for improved surface softening techniques that can be applied to such tissue products to provide the requisite softness without unacceptably degrading the strength of the product or other important properties thereof. Further, there is a need for surface softened tissue paper webs in which the surface softener is applied by non-compressive techniques to the outermost elevation of a multi-elevation web. Finally, there is a need for providing a two-sided surface softened tissue paper web using a one-sided surface application of the softening technique.

Such improved products and methods are provided by the present invention as is shown in the following disclosure.

SUMMARY OF THE INVENTION

The present invention describes a dual-sided surface softened tissue paper web and a process of making the web, wherein a surface softening composition is initially applied, preferably by a single-sided, non-compressive application, to one side of the web, and then is transferred to the other side of the web by contact between one side and the other side of the web.

The process comprises the following steps: providing a fibrous web having a first side and a second side opposite to the first side; providing a chemical additive; depositing the chemical additive only to the first side of the fibrous web; and causing the first side of the fibrous web to contact the second side of the fibrous web thereby partially transferring the chemical additive from the first side to the second side of the fibrous web such that both the first side and the second side of the fibrous web comprise the chemical additive in a functionally sufficient amount. As used herein, the functionally sufficient amount is preferably at least 0.05 gram of the additive per square meter of the web. In terms of surface concentration, the functionally sufficient amount is preferably at least 20 pounds of the additive per ton of the surface fibers (lb/ton), more preferably at least 50 lb/ton, and most preferably at least 90 lb/ton.

Preferably, the step of causing the first side of the fibrous web to contact the second side of the fibrous web comprises transferring the chemical additive from a first position on the first side of the fibrous web to a second position on the second side of the fibrous web, the second position being off-set from the first position relative to a plane of the web. In the preferred embodiment of the process, the web continuously travels in a machine direction, in which instance the second position on the second side of the fibrous web is off-set in the machine direction from the first position on the first side of the fibrous web.

In the most preferred embodiment, as the web travels in the machine direction, it is continuously wound into a roll, thereby causing the first side having the chemical functional additive thereon to contact the second side of the web. The amount of the chemical additive transferred from the first side of the fibrous web to the second side of the fibrous web is such that a ratio of a surface concentration of the chemical additive on the second side to a surface concentration of the chemical additive on the first side is preferably at least 1:4, more preferably at least 1:2, and most preferably about 1:1.

The step of depositing the chemical additive only to the first side of the fibrous web may comprise extrusion coating, spray coating, print coating or any combination thereof.

Preferably, the chemical additive is selected from the group consisting of softeners, emulsions, emollients, lotions, topical medicines, soaps, anti-microbial and anti-bacterial agents, moisturizers, coatings, inks and dies, strength additives, absorbency additives, binders, opacity agents, fillers, and combinations thereof. The chemical additive is preferably a chemical softener selected from the group consisting of lubricants, plasticizers, cationic debonders, noncationic debonders, and mixtures thereof. The preferred chemical softener comprises a quaternary ammonium compound.

The chemical additive comprising a strength additive may be selected from the group consisting of permanent wet-strength resins, temporary wet-strength resins, dry-strength resins, and mixtures thereof.

The chemical additive comprising an absorbency additive may be selected from the group consisting of polyethoxylates, alkylethoxylated esters, alkylethoxylated alcohols, alkylpolyethoxylated nonylphenols, and mixtures thereof.

For the purposes of effective transferal of the chemical additive from the first side to the second side of the web, it is important to maintain the chemical additive deposited onto the first side of the web in a transferable condition. For this purpose, it is useful to provide a ratio of an open time to a drop absorbency time preferably less than about 3.0, more preferably less than about 1.0, and most preferably less than about 0.5.

In the preferred embodiment, the first side of the fibrous web comprises a first region and a second region, the first region being raised above the second region. In this instance, the step of depositing the chemical additive to the first side of the fibrous web comprises depositing the additive, preferably non-compressively, to the first region of the first side of the fibrous web. More preferably, the fibrous web comprises a pattern-densified structure wherein the first region has a first density and the second region has a second density, the first density and the second density being unequal, and preferably the first density is lower than the second density.

The step of depositing the chemical additive only to the first side of the fibrous web may be conducted during the papermaking process (as opposed to a converting process).

As used herein, all percentages, ratios and proportions herein are by weight, unless otherwise specified.

BRIEF DESCRIPTION OF THE DRAWINGS

While the specification concludes with claims particularly pointing out and distinctly claiming the present invention, it is believed that the present invention will be better understood from the following description in conjunction with the appended examples and with the following drawings, in which like reference numbers identify identical elements and wherein:

DETAILED DESCRIPTION OF THE INVENTION

Figure 1:
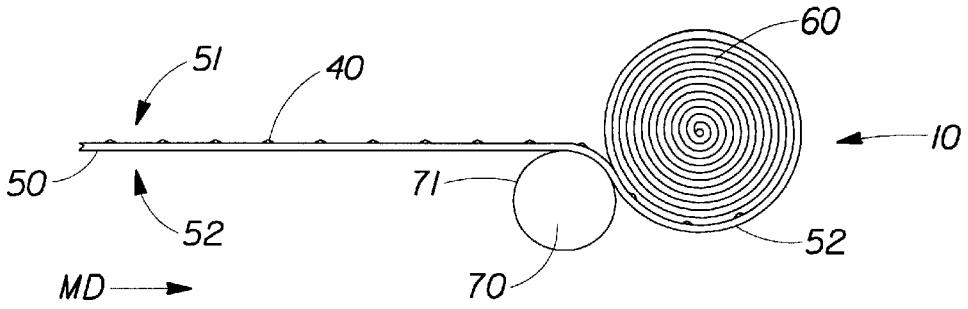
FIG. 1 is a schematic side view of a process of the present invention.

Briefly, the present invention provides a process whereby a chemical functional additive may be applied to one side of a fibrous web and then is transferred, by contact (as opposed to wicking through), to the other side of the web. The additive may be applied to a dry or to a semi-dry web. The resulting tissue paper has a functionally sufficient amount of the additive on each side and thus—enhanced property, such as, for example, tactilely perceivable softness.

The term "dry tissue web" as used herein includes both webs which are dried to a moisture content less than the equilibrium moisture content thereof and webs which are at a moisture content in equilibrium with atmospheric moisture. A semi-dry tissue paper web includes a tissue web with a moisture content exceeding its equilibrium moisture content. Most preferably the composition herein is applied to a dry tissue paper web.

The preferred softening composition, as well as a method for producing the combination and a method of applying it to tissue are also described.

Surprisingly, it has been found that very low levels of softener additives, e.g. cationic softeners, provide a significant tissue softening effect when applied to the surface of tissue webs in accordance with the present invention. Importantly, it has been found that the levels of softener additives used to soften the tissue paper are low enough that the tissue paper retains high wettability. Furthermore, because the softening composition has a high active level when the softening composition is applied, the composition can be applied to dry tissue webs without requiring further drying of the tissue web.

The present invention may be employed using a hot tissue web. As used herein, the term "hot tissue web" refers to a tissue web which is at an elevated temperature relative to a room temperature. Generally, the elevated temperature of a hot tissue web is at least about 43° C., and frequently more than about 65° C.

The moisture content of a tissue web is related to the temperature of the web and the relative humidity of the environment in which the web is placed. As used herein, the term "overdried tissue web" refers to a tissue web that is dried to a moisture content less than its equilibrium moisture content at standard test conditions of 23° C. and 50% relative humidity. The equilibrium moisture content of a tissue web placed in standard testing conditions of 23° C. and 50% relative humidity is approximately 7%. A tissue web of the present invention can be overdried by raising it to an elevated temperature through use of drying means known to the art such as a Yankee dryer or through air drying. Preferably, an overdried tissue web will have a moisture content of less than 7%, more preferably from about 0 to about 6%, and most preferably, a moisture content of from about 0 to about 3%, by weight.

Paper exposed to the normal environment typically has an equilibrium moisture content in the range of 5 to 8%. When paper is dried and creped the moisture content in the sheet is generally less than 3%. After manufacturing, the paper absorbs water from the atmosphere. In the preferred process of the present invention, advantage is taken of the low moisture content in the paper as it leaves the doctor blade as it is removed from the Yankee dryer (or the low moisture content of similar webs as such webs are removed from alternate drying means if the process does not involve a Yankee dryer).

In one embodiment, the composition of the present invention is applied to an overdried tissue web shortly after it is separated from a drying means and before it is wound onto a parent roll. Alternatively, the composition of the present invention may be applied to a semi-dry tissue web, for example while the web is on the Fourdrinier cloth, on a drying felt or fabric, or while the web is in contact with the Yankee dryer or other alternative drying means. Finally, the composition can also be applied to a dry tissue web in moisture equilibrium with its environment as the web is unwound from a parent roll as for example during an off-line converting operation.

Fibrous Web

The fibrous web can be made by a variety of methods known in the art, all of which are contemplated by the present invention. These methods include conventional paper making, through-air-dried paper making, and multiple basis weight paper making.

The present invention is applicable to tissue paper in general, including but not limited to: conventionally felt-pressed tissue paper; pattern-densified tissue paper, and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 g/m$^2$ and about 200 g/m$^2$ and density of about 0.60 g/cc or less. Preferably, the basis weight is about 100 g/m$^2$ or less, and the density is about 0.30 g/cc or less. Most preferably, the density is between about 0.04 g/cc and about 0.20 g/cc.

Conventionally pressed tissue paper and methods for making such paper are known in the art. Such paper is typically made by depositing a papermaking furnish on a foraminous forming wire. This forming wire is often referred to in the art as a Fourdrinier wire. Once the furnish is deposited on the forming wire, it is referred to as a web. Overall, water is removed from the web by vacuum, mechanical pressing, and thermal means. The web is dewatered by pressing the web and by drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 45% (total web weight basis) by vacuum dewatering and further dried by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted, since the web is subjected to substantial overall mechanical compression forces while the fibers are moist and are then dried while in a compressed state. The resulting structure is strong and generally of singular density, but very low in bulk, absorbency and in softness.

Pattern-densified tissue paper is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field.

The present invention can also be applied to uncreped tissue paper. Uncreped tissue paper, a term as used herein, refers to tissue paper which is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete.

To produce uncreped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

The techniques to produce uncreped tissue in this manner are taught in the prior art. For example, Wendt, et. al. in European Patent Application 0 677 612A2, published Oct. 18, 1995 and incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped through air dried sheets. Finally, Farrington, et. al. in U.S. Pat. No. 5,656,132 published Aug. 12, 1997, the disclosure of which is incorporated herein by reference, describes the use of a machine to make soft through air dried tissues without the use of a Yankee.

Figure 4:
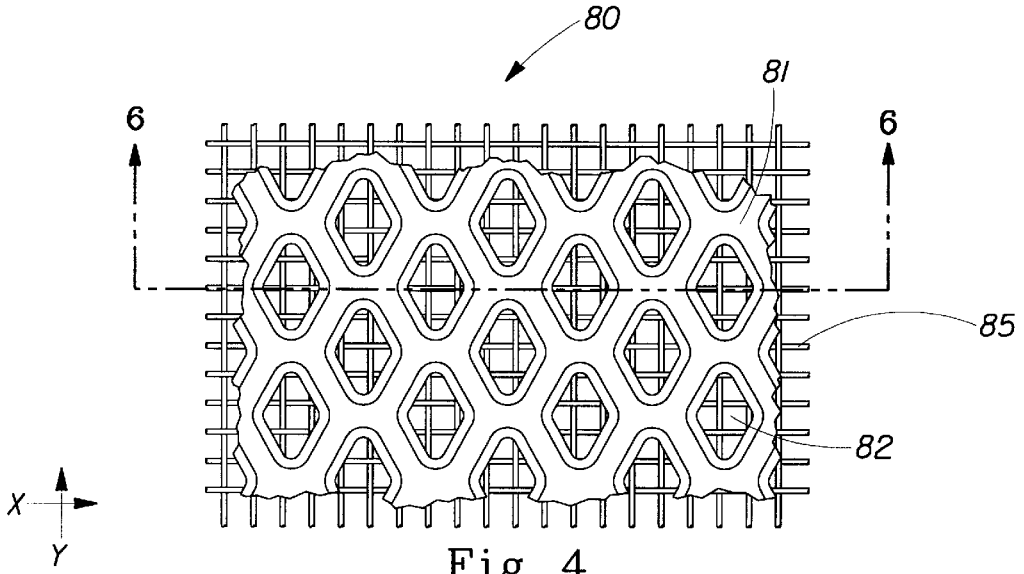
FIG. 4 is a schematic plan view of one embodiment of the papermaking belt for making a product according to the present invention.
Figure 5:
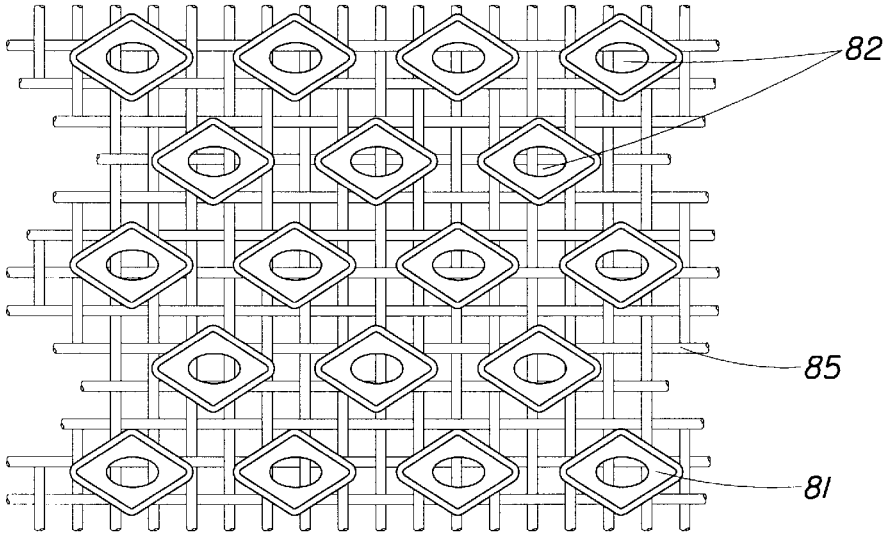
FIG. 5 is a plan view of another embodiment of the papermaking belt for making a product according to the present invention.
Figure 6:
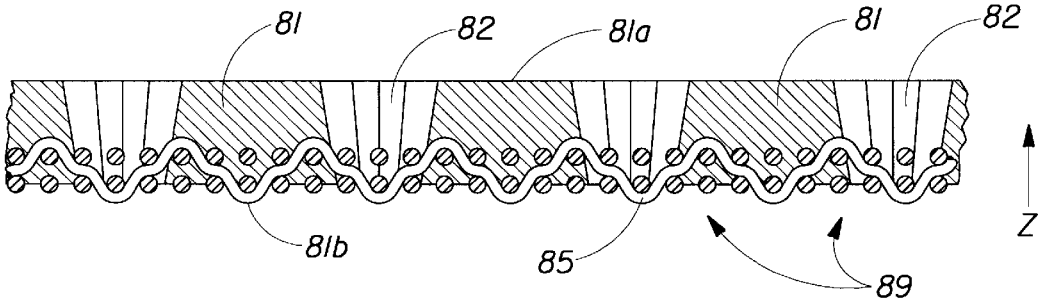
FIG. 6 is a schematic cross-sectional view taken along lines 6—6 of FIG. 3.

In a preferred embodiment, the paper can be made using a resin coated forming belt 80, as depicted schematically in FIGS. 4–6. A reinforcing structure 85 is joined to a resinous framework 81. The resinous framework 81 preferably comprises a cured polymeric photosensitive resin. The framework 81 (and the entire belt) has a web-contacting surface 81*a* and an opposed backside surface 81*b* oriented towards the papermaking machinery on which the belt is used.

In one embodiment, FIG. 4, the substantially continuous resinous framework 81 has a plurality of deflection conduits 82 therethrough. In another embodiment, FIG. 5, the resinous framework comprises a plurality of discrete protuberances extending outwardly from the reinforcing structure 85. The protuberances are upstanding from the plane (X-Y) of the papermaking belt and are preferably discrete. The protuberances obturate drainage through selected regions of the papermaking belt, and may produce low and high basis weight regions in the paper, respectively. Each protuberance may, if desired, have a deflection conduit 82 therethrough. An embodiment (not shown) is contemplated comprising a combination of the substantially continuous resinous framework and the plurality of discrete protuberances.

The papermaking belt is macroscopically monoplanar. The plane of the papermaking belt defines its X-Y directions. Perpendicular to the plan formed by X-Y directions (and the plane of the papermaking belt) is the Z-direction of the belt (FIG. 6). Likewise, the paper according to the present invention can be thought of as macroscopically monoplanar and lying in an X-Y plane. Perpendicular to the X-Y directions and the plane of the paper is the Z-direction of the paper (FIG. 6).

Preferably the resinous framework 81 defines a predetermined pattern, which imprints a similar pattern onto the paper of the present invention. A particularly preferred pattern for the framework is an essentially continuous network shown in FIG. 4. If the preferred essentially continuous network pattern is selected for the framework, discrete deflection conduits 82 will extend between two opposite surfaces of the belt. The essentially continuous network 81 surrounds and defines the deflection conduits 82.

The web-contacting surface 81*a* of the belt contacts the paper carried thereon. During papermaking, the web-contacting surface of the belt may imprint a pattern onto the paper corresponding to the pattern of the framework. The framework 81 imprints a pattern corresponding to that of the framework 81 onto the paper carried thereon. Imprinting occurs anytime the belt and paper pass between two rigid surfaces having a clearance sufficient to cause imprinting. This commonly occurs in a nip between two rolls. This most commonly occurs when the belt transfers the paper to a Yankee drying drum. Imprinting is caused by compression of the framework 81, against the paper at the surface of the pressure roll.

The backside surface 81*b* of the belt is the machine-contacting surface of the belt. The backside surface 81*b* may be made with a backside network having passageways 89 (FIG. 6) therein which are distinct from the deflection conduits. The passageways provide irregularities in the texture of the backside of the belt. The passageways allow for air leakage in the X-Y plane of the belt, thereby mitigating a sudden application of pressure differential, such as vacuum pressure, which in turn mitigates formation of so-called "pinholes" in the paper web.

The second primary component of the belt is the reinforcing structure 85. The reinforcing structure 85, like the framework 81, has two opposite sides, one being a web-facing side and the other a machine-facing side opposite the web-facing side. The reinforcing structure is primarily disposed between the opposed surfaces 81*a*, 81*b* of the belt and may have a surface coincident with the backside surface 81*b* of the belt. The reinforcing structure 85 provides support for the framework 81. The reinforcing structure component is typically woven, as is well known in the art. The portions of the reinforcing structure 85 registered with the deflection conduits 82 prevent papermaking fibers from passing completely through the deflection conduits 82 and thereby reduce the occurrences of pinholes. If one does not wish to use a woven fabric for the reinforcing structure, a non-woven element, screen, net, or a plate having a plurality of holes therethrough may provide adequate strength and support for the framework of the present invention.

The papermaking belt may be made according to any of commonly assigned U.S. Pat. Nos.: 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; 5,628,876 issued May 13, 1997 to Ayers et al.; 5,679,222 issued Oct. 21, 1997 to Rasch et al.; and 5,714,041 issued Feb. 3, 1998 to Ayers et al., the disclosures of which are incorporated herein by reference.

The papermaking belt for use with the present invention may also be made according to commonly assigned U.S. Pat. Nos. 5,503,715, issued Apr. 2, 1996 to Trokhan et al.; 5,614,061, issued Mar. 25, 1997 to Phan et al.; 5,804,281 issued Sep. 8, 1998 to Phan et al., and 5,820,730, issued Oct. 13, 1998 to Phan et al., the disclosures of which are incorporated herein by reference.

Figure 3:
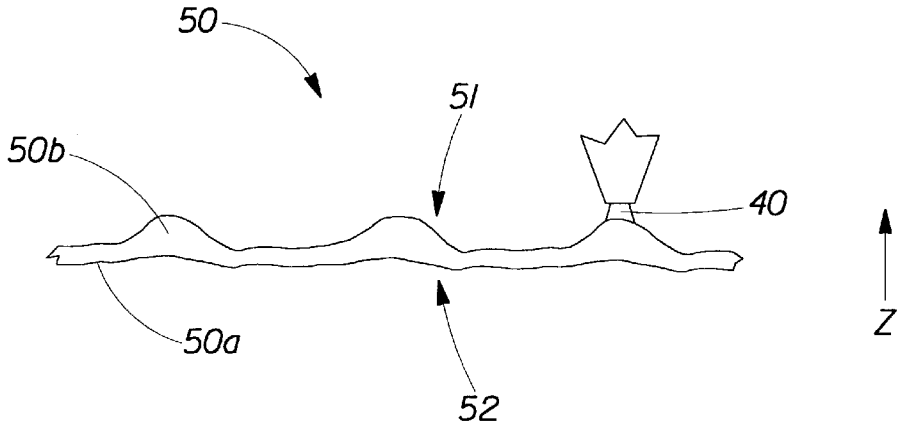
FIG. 3 is a schematic side-elevational view of the paper product of the present invention.

The fibrous web 50, shown in FIG. 3, can have two primary regions. A first region 50*a* can comprise an imprinted region which is imprinted against the framework 81 of the belt. The imprinted region preferably comprises an essentially continuous network. The continuous network of the first region of the paper is made on the essentially continuous framework 81 of the belt and will generally correspond thereto in geometry and be disposed very closely thereto in position during papermaking.

A second region 50*a* of the paper 50 can comprise a plurality of domes dispersed throughout the imprinted network region. The domes generally correspond in geometry, and during papermaking in position, to the deflection conduits 82 in the belt. The domes protrude outwardly from the essentially continuous network region of the paper, by conforming to the deflection conduits during the papermaking process. By conforming to the deflection conduits during the papermaking process, the fibers in the domes are deflected in the Z-direction between the web-facing surface of the framework 81 and the web-facing side of the reinforcing structure 85. Preferably the domes are discrete.

Without being bound by theory, applicants believe that the domes and essentially continuous network regions of the paper may have generally equivalent basis weights. By deflecting the domes into the deflection conduits, the density of the domes is decreased relative to the density of the essentially continuous network region. Moreover, the essentially continuous network region (or pattern as may be selected) may later be imprinted as, for example, against a Yankee drying drum. Such imprinting increases the density of the essentially continuous network region relative to that of the domes. The resulting paper may be later embossed as is well known in the art.

The paper according to the present invention may be made according to any of commonly assigned U.S. Pat. Nos.: 4,529,480, issued Jul. 16, 1985 to Trokhan; 4,637,859, issued Jan. 20, 1987 to Trokhan; 5,364,504, issued Nov. 15, 1994 to Smurkoski et al.; and 5,529,664, issued Jun. 25, 1996 to Trokhan et al. and 5,679,222 issued Oct. 21, 1997 to Rasch et al., the disclosures of which are incorporated herein by reference.

If desired, the paper may be dried and made on a through-air drying belt which does not have a patterned framework. Such paper will have discrete, high density regions and an essentially continuous low density network. During or after drying, the paper may be subjected to a differential (vacuum) pressure to increase its caliper and de-densify selected regions. Such paper, and the associated belt, may be made according to the following U.S. Pat. Nos.: 3,301,746, issued Jan. 31, 1967 to Sanford et al.; 3,905,863, issued Sep. 16, 1975 to Ayers; 3,974,025, issued Aug. 10, 1976 to Ayers; 4,191,609, issued Mar. 4, 1980 to Trokhan; 4,239,065, issued Dec. 16, 1980 to Trokhan; 5,366,785 issued Nov. 22, 1994 to Sawdai; and 5,520,778, issued May 28, 1996 to Sawdai, the disclosures of which are incorporated herein by reference.

In yet another embodiment, the reinforcing structure may comprise a felt, also referred to as a press felt, as is used in conventional papermaking without through-air drying. The framework may be applied to the felt reinforcing structure as taught by commonly assigned U.S. Pat. Nos. 5,549,790, issued Aug. 27, 1996 to Phan; 5,556,509, issued Sep. 17, 1996 to Trokhan et al.; 5,580,423, issued Dec. 3, 1996 to Ampulski et al.; 5,609,725, issued Mar. 11, 1997 to Phan; 5,629,052 issued May 13, 1997 to Trokhan et al.; 5,637,194, issued Jun. 10, 1997 to Ampulski et al.; 5,674,663, issued Oct. 7,1997 to McFarland et al.; 5,693,187 issued Dec. 2, 1997 to Ampulski et al.; 5,709,775 issued Jan. 20, 1998 to Trokhan et al., 5,795,440 issued Aug. 18, 1998 to Ampulski et al., 5,814,190 issued Sep. 29, 1998 to Phan; 5,817,377 issued Oct. 6, 1998 to Trokhan et al.; and 5,846,379 issued Dec. 8, 1998 to Ampulski et al., the disclosures of which are incorporated herein by reference.

The paper may also be foreshortened, as is known in the art. Foreshortening can be accomplished by creping the paper from a rigid surface, and preferably from a cylinder. A Yankee drying drum is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught by commonly assigned U.S. Pat. No. 4,440,597, issued Apr. 3, 1984 to Wells et al., the disclosure of which is incorporated herein by reference.

If desired, the paper may have multiple basis weights. Preferably the multiple basis weight paper has two or more distinguishable regions: regions with a relatively high basis weight, and regions with a relatively low basis weight. Preferably the high basis weight regions comprise an essentially continuous network. The low basis weight regions may be discrete. If desired, the paper according to present invention may also comprise intermediate weight regions disposed within the low basis weight regions. Such paper may be made according to commonly assigned U.S. Pat. No. 5,245,025, issued Sep. 14, 1993 to Trokhan et al., the disclosure of which is incorporated herein by reference. If the paper has only two different basis weight regions, an essentially continuous high basis weight region, with discrete low basis weight regions disposed throughout the essentially-continuous high basis weight region, such paper may be made according to commonly assigned U.S. Pat. Nos. 5,527,428 issued Jun. 18, 1996 to Trokhan et al.; 5,534,326 issued Jul. 9, 1996 to Trokhan et al.; and 5,654,076, issued Aug. 5, 1997 to Trokhan et al., the disclosures of which are incorporated herein by reference.

One may further wish to densify selected regions of the paper. Such paper will have both multiple density regions and multiple basis weight regions. Such paper may be made according to commonly assigned U.S. Pat. Nos. 5,277,761, issued Jan. 11, 1994 to Phan et al.; 5,443,691, issued Aug. 22, 1995 to Phan et al., and 5,804,036 issued Sep. 8, 1998 to Phan et al., the disclosures of which are incorporated herein by reference.

If desired, in place of a belt having the patterned framework described above, a belt having a jacquard weave may be utilized. Such a belt may be utilized as a forming wire, drying fabric, imprinting fabric, transfer clothing etc. A Jacquard weave is reported in the literature to be particularly useful where one does not wish to compress or imprint the paper in a nip, such as typically occurs upon transfer to a Yankee drying drum. Illustrative belts having a Jacquard weave are found in U.S. Pat. Nos. 5,429,686 issued Jul. 4, 1995 to Chiu et al. and 5,672,248 issued Sep. 30,1997 to Wendt et al.

The paper according to the present invention may be layered. If the paper is layered, a multi-channel headbox may be utilized as is known in the art. Such a headbox may have two, three, or more channels. Each channel may be provided with a different cellulosic fibrous slurry. Optionally, the same slurry may be provided in two or more of the channels. However, one of ordinary skill will recognize that if all channels contain the same furnish a blended paper will result.

Typically, the paper is layered so that shorter hardwood fibers are on the outside to provide a soft tactile sensation to the user. Longer softwood fibers are on the inside for strength. Thus, a three-channel headbox may produce a single-ply product, having two outer plies comprising predominantly hardwood fibers and a central ply comprising predominantly softwood fibers.

Alternatively, a two-channel headbox may produce a paper having one layer of predominantly softwood fibers and one layer of predominantly hardwood fibers. Such a paper is joined to another ply of a like paper, so that the softwood layers of the resulting two-ply laminate are inwardly oriented toward each other and the hardwood layers are outwardly facing.

In an alternative manufacturing technique, multiple headboxes may be utilized in place of a single headbox having multiple channels. In the multiple headbox arrangement, the first headbox deposits a discrete layer of cellulosic fibers onto the forming wire. The second headbox deposits a second layer of cellulosic fibers onto the first. While, of course, some intermingling between the layers occurs, a predominantly layered paper results.

Layered paper of constant basis weight may be made according to the teachings of commonly assigned U.S. Pat. Nos.: 3,994,771, issued Nov. 30, 1976 to Morgan, Jr. et al.; 4,225,382, issued Sep. 30, 1980 to Kearney et al.; and 4,300,981, issued Nov. 17, 1981 to Carstens, the disclosures of which are incorporated herein by reference.

Furnish

Preferably, the furnish is first formed into a wet web on a foraminous forming carrier, such as a Fourdrinier wire. The web is dewatered and transferred to an imprinting fabric. The furnish may alternatively be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Papermaking Fibers

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

Functional Additives

As used herein, the terms "functional additive," "chemical functional additive," "chemical additive," "chemical composition" and permutations thereof refer to substances that may be added to the paper web to improve the web's functional characteristics, such as, for example, softness, strength, and absorbency. Depending on a particular process, functional additives may be added to papermaking fibers during formation of the paper web, or/and by applying the additive to one or both surfaces of the web after the web has generally been formed. If the functional additive is applied to at least one surface of the web, it may be desirable to apply the functional additive, such for example as a softener, in such a way that the additive remains on the surface of the web and does not penetrates the web's thickness.

A variety of materials can be added to the aqueous papermaking furnish or the embryonic web to impart other desirable characteristics to the product or improve the papermaking process so long as they are mutually compatible and do not significantly and adversely affect the softness or strength character of the product of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. , 5,221,435, issued to Smith on Jun. 22, 1993, the disclosure of which is incorporated herein by reference. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene lattices; insolubilized polyvinyl alcohol; urea-formaldehyde; polyethyleneimine; chitosan polymers and mixtures thereof can be added to the papermaking furnish or to the embryonic web. Preferred resins are cationic wet strength resins, such as polyamide-epichlorohydrin resins. Suitable types of such resins are described in U.S. Pat. Nos. 3,700,623, issued on Oct. 24, 1972, and 3,772,076, issued on Nov. 13, 1973, both to Keim, the disclosure of both being hereby incorporated by reference. One commercial source of useful polyamide-epichlorohydrin resins is Hercules, Inc. of Wilmington, Del., which markets such resin under the mark Kymene 557H®.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, the disclosure of which is incorporated herein by reference, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.).

While the essence of the present invention is the presence of a softening agent composition deposited on the tissue web surface, the invention also expressly includes variations in which chemical softening agents are added as a part of the papermaking process. For example, chemical softening agents may be included by wet end addition. Preferred chemical softening agents comprise quaternary ammonium compounds including, but not limited to, the well-known dialkyldimethylammonium salts (e.g. ditallowdimethylammonium chloride, ditallowdimethylammonium methyl sulfate, di(hydrogenated tallow)dimethyl ammonium chloride, etc.). Particularly preferred variants of these softening agents are what are considered to be mono or diester variations of the before mentioned dialkyldimethylammonium salts. Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997, and, incorporated herein by reference discloses filled tissue paper products that are acceptable as substrates for the present invention.

The above listings of optional chemical additives is intended to be merely exemplary in nature, and are not meant to limit the scope of the invention.

Softening Composition

The present invention has particular utility in the field of applying softening compositions (or softeners). A particularly preferred composition comprises a dispersion of a softening active ingredient in a vehicle. When applied to tissue paper as described herein, such compositions are effective in softening the tissue paper. A preferred softening composition has properties (e.g., ingredients, rheology, pH, etc.) permitting easy application thereof on a commercial scale. For example, while certain volatile organic solvents may readily dissolve high concentrations of effective softening materials, such solvents are not desired because of the increased process safety and environmental burden (VOC) concerns raised by such solvents. The following discusses each of the components of a preferred softening composition of the present invention, the properties of the composition, methods of producing the composition, and methods of applying the composition.

Components

Softening Active Ingredients

Quaternary compounds having the formula:

$$(R_1)_{4-m}{}^{-N+}-[R_2]_m\ X^-$$

wherein:

m is 1 to 3;

each $R_1$ is a $C_{1-C6}$ alkyl group, hydroxyalkyl group, hydrocarbyl or substituted hydrocarbyl group, alkoxylated group, benzyl group, or mixtures thereof;

each R2 is a $C_{14-C22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention. Preferably, each $R_1$ is methyl and $X^-$ is chloride or methyl sulfate. Preferably, each $R_2$ is $C_{16-C18}$ alkyl or alkenyl, most preferably each $R_2$ is straight-chain $C_{18}$ alkyl or alkenyl. Optionally, the $R_2$ substituent can be derived from vegetable oil sources. Several types of the vegetable oils (e.g., olive, canola, safflower, sunflower, etc.) can used as sources of fatty acids to synthesize the quaternary ammonium compound.

Such structures include the well-known dialkyldimethylammonium salts (e.g. ditallowdimethylammonium chloride, ditallowdimethylammonium methyl sulfate, di(hydrogenated tallow)dimethyl ammonium chloride, etc.), in which $R_1$ are methyl groups, $R_2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch (partially hydrogenated) or completely hydrogenated (hard). All of above-described saturation levels of are expressly meant to be included within the scope of the present invention.

Particularly preferred variants of these softening active ingredients are what are considered to be mono or diester variations of these quaternary ammonium compounds having the formula:

$$(R_1)_{4-m}{}^{-N+}-[(CH_2)_n-Y-R_3]_m\ X^-$$

wherein

Y is —O—(O)C—, or —C(O)—O—, or —NH—C(O)—, or —C(O)—NH—;

m is 1 to 3;

n is 0 to 4;

each $R_1$ is a $C_1$–$C_6$ alkyl group, hydroxyalkyl group, hydrocarbyl or substituted hydrocarbyl group, alkoxylated group, benzyl group, or mixtures thereof;

each $R_3$ is a $C_{13}$–$C_{21}$ alkyl group, hydroxyalkyl group, hydrocarbyl or substituted hydrocarbyl group, alkoxylated group, benzyl group, or mixtures thereof; and $X^-$ is any softener-compatible anion.

Preferably, Y=—O—(O)C—, or —C(O)—O—; m=2; and n=2. Each $R_1$ substituent is preferably a $C_1$–$C_3$, alkyl group, with methyl being most preferred. Preferably, each $R_3$ is $C_{13}$–$C_{17}$ alkyl and/or alkenyl, more preferably $R_3$ is straight chain $C_{15}$–$C_{17}$ alkyl and/or alkenyl, $C_{15}$–$C_{17}$ alkyl, most preferably each $R_3$ is straight-chain $C_{17}$ alkyl. Optionally, the $R_3$ substituent can be derived from vegetable oil sources. Several types of the vegetable oils (e.g., olive, canola, safflower, sunflower, etc.) can used as sources of fatty acids to synthesize the quaternary ammonium compound. Preferably, olive oils, canola oils, high oleic safflower, and/or high erucic rapeseed oils are used to synthesize the quaternary ammonium compound.

As mentioned above, $X^-$ can be any softener-compatible anion, for example, acetate, chloride, bromide, methylsulfate, formate, sulfate, nitrate and the like can also be used in the present invention. Preferably $X^-$ is chloride or methyl sulfate.

Specific examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated) tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename ADOGEN SDMC.

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the degree of saturation for such tallows can be tailored from non hydrogenated (soft), to partially hydrogenated (touch), or completely hydrogenated (hard). All of above-described saturation levels of are expressly meant to be included within the scope of the present invention.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$–$C_{18}$ alkyl and/or alkenyl, most preferably each $R_2$ is straight-chain $C_{16}$–$C_{18}$ alkyl and/or alkenyl, most preferably each $R_2$ is straight-chain $C_{18}$ alkyl or alkenyl. Preferably $R_3$ is $C_{13}$–$C_{17}$ alkyl and/or alkenyl, most preferably $R_3$ is straight chain $C_{15}$–$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g.:

$$(R_1)_2\text{-}N^+\text{-}((CH_2)_2OH)\ ((CH_2)_2OC(O)(R_3)X^-$$

as minor ingredients. These minor ingredients can act as emulsifiers and are useful in the present invention.

Other types of suitable quaternary ammonium compounds for use in the present invention are described in U.S. Pat. Nos. 5,543,067, issued to Phan et al. on Aug. 6, 1996; 5,538,595, issued to Trokhan et al., on Jul. 23, 1996; 5,510,000, issued to Phan et al. on Apr. 23, 1996; 5,415,737, issued to Phan et al., on May 16, 1995; and European Patent Application No. 0 688 901 A2, assigned to Kimberly-Clark Corporation, published Dec. 12, 1995; the disclosure of each of which is incorporated herein by reference.

Di-quat variations of the ester-functional quaternary ammonium compounds can also be used, and are meant to fall within the scope of the present invention. These compounds have the formula:

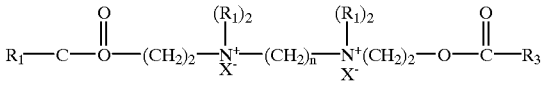

In the structure named above each $R_1$ is a $C_1$–$C_6$alkyl or hydroxyalkyl group, $R_3$ is $C_{11}$–$C_{21}$ hydrocarbyl group, n is 2 to 4 and $X^-$ is a suitable anion, such as an halide (e.g., chloride or bromide) or methyl sulfate. Preferably, each $R_3$ is $C_{13}$–$C_{17}$ alkyl and/or alkenyl, most preferably each $R_3$ is straight-chain $C_{15}$–$C_{17}$ alkyl and/or alkenyl, and $R_1$ is a methyl.

Parenthetically, while not wishing to be bound by theory, it is believed that the ester moiety(ies) of the aforementioned quaternary compounds provides a measure of biodegradability to such compounds. Importantly, the ester-functional quaternary ammonium compounds used herein biodegrade more rapidly than do conventional dialkyl dimethyl ammonium chemical softeners.

The use of quaternary ammonium ingredients as described herein above is most effectively accomplished if the quaternary ammonium ingredient is accompanied by an appropriate plasticizer. The term plasticizer as used herein refers to an ingredient capable of reducing the melting point and viscosity at a given temperature of a quaternary ammonium ingredient. The plasticizer can be added during the quaternizing step in the manufacture of the quaternary ammonium ingredient or it can be added subsequent to the quaternization but prior to the use as an additive on a fibrous web. The plasticizer is characterized by being substantially inert during the chemical synthesis, during which acts as a viscosity reducer to aid in the synthesis. Preferred plasticizers are non-volatile polyhydroxy compounds. Preferred polyhydroxy compounds include glycerol and polyethylene glycols having a molecular weight of from about 200 to about 2000, with polyethylene glycol having a molecular weight of from about 200 to about 600 being particularly preferred. When such plasticizers are added during manufacture of the quaternary ammonium ingredient, they comprise between about 5% and about 75% percent of the product of such manufacture. Particularly preferred mixtures comprise between about 15% and about 50% plasticizer.

Vehicle

A term "vehicle," as used herein, means a fluid that completely dissolves a chemical papermaking additive, or a fluid that is used to emulsify a chemical papermaking additive, or a fluid that is used to suspend a chemical papermaking additive. The vehicle may also serve as a carrier that contains a chemical additive or aids in the delivery of a chemical papermaking additive. All references are meant to be interchangeable and not limiting. The dispersion is the fluid containing the chemical papermaking additive. The term "dispersion" as used herein includes true solutions, suspensions, and emulsions. For purposes for this invention, all terms are interchangeable and not limiting. If the vehicle is water or an aqueous solution, then, preferably, the hot web is dried to a moisture level below its equilibrium moisture content (at standard conditions) before being contacted with the composition. However, this process is also applicable to tissue paper at or near its equilibrium moisture content as well.

The vehicle is used to dilute the active ingredients of the compositions described herein forming the dispersion of the present invention. A vehicle may dissolve such components (true solution or micellar solution) or such components may be dispersed throughout the vehicle (dispersion or emulsion). The vehicle of a suspension or emulsion is typically the continuous phase thereof. That is, other components of the dispersion or emulsion are dispersed on a molecular level or as discrete particles throughout the vehicle.

For purposes of the present invention, one purpose that the vehicle serves is to dilute the concentration of softening active ingredients so that such ingredients may be efficiently and economically applied to a tissue web. For example, as is discussed below, one way of applying such active ingredients is to spray them onto a roll which then transfers the active ingredients to a moving web of tissue. Typically, only very low levels (e. g. on the order of 2% by weight of the associated tissue) of softening active ingredients are required to effectively improve the tactile sense of softness of a tissue. This means very accurate metering and spraying systems would be required to distribute a "pure" softening active ingredient across the full width of a commercial-scale tissue web.

Another purpose of the vehicle is to deliver the active softening composition in a form in which it is less prone to be mobile with regard to the tissue structure. Specifically, it is desired to apply the composition of the present invention so that the active ingredient of the composition resides primarily on the surface of the absorbent tissue web with minimal absorption into the interior of the web. While not wishing to be bound by theory, the Applicants believe that the interaction of the softening composition with preferred vehicles creates a suspended particle which binds more quickly and permanently than if the active ingredient were to be applied without the vehicle. For example, it is believed that suspensions of quaternary softeners in water assume a liquid crystalline form which can be substantively deposited onto the surface of the fibers of the surface of the tissue paper web. Quaternary softeners applied without the aid of the vehicle, i.e. applied in molten form by contrast tend to wick into the internal of the tissue web.

The Applicants have discovered vehicles and softening compositions comprising such vehicles that are particularly useful for facilitating the application of softening active ingredients to webs of tissue on a commercial scale.

In the simplest execution of the present invention, softening ingredients can be dissolved in a vehicle forming a solution therein. However, as noted above, materials that are useful as solvents for suitable softening active ingredients are not commercially desirable for safety and environmental reasons. Therefore, to be suitable for use in the vehicle for purposes of the present invention, a material should be compatible with the softening active ingredients described herein and with the tissue substrate on which the softening compositions of the present invention will be deposited. Further a suitable material should not contain any ingredients that create safety issues (either in the tissue manufacturing process or to users of tissue products using the softening compositions described herein) and not create an unacceptable risk to the environment. Suitable materials for the vehicle of the present invention include hydroxyl functional liquids most preferably water.

Electrolyte

While water is a particularly preferred material for use in the vehicle of the present invention, water alone is not preferred as a vehicle. Specifically, when the preferred softening active ingredients of the present invention are dispersed in water at a level suitable for application to a tissue web, the dispersion has an unacceptably high viscosity. While not being bound by theory, the Applicants believe that combining water and the softening active ingredients of the present invention to form such dispersions creates a liquid crystalline phase having a high viscosity. Compositions having such a high viscosity are difficult to apply to tissue webs for softening purposes.

The Applicants have discovered that the viscosity of dispersions of softening active ingredients in water can be substantially reduced, while maintaining a desirable high level of the softening active ingredient in the softening composition by the simple addition of a suitable electrolyte to the vehicle. Again, not being bound by theory, the Applicants believe that electrolytes function in part by shielding the electrical double layer surrounding an aqueous suspension of particles of the cationic softening active ingredient.

Any electrolyte meeting the general criteria described above for materials suitable for use in the vehicle of the present invention and which is effective in reducing the viscosity of a dispersion of a softening active ingredient in water is suitable for use in the vehicle of the present invention. In particular, any of the known water-soluble electrolytes meeting the above criteria can be included in the vehicle of the softening composition of the present invention. When present, the electrolyte can be used in amounts up to about 25% by weight of the softening composition, but preferably no more than about 15% by weight of the softening composition. Preferably, the level of electrolyte is between about 0.1% and about 10% by weight of the softening composition based on the anhydrous weight of the electrolyte. Still more preferably, the electrolyte is used at a level of between about 0.3% and about 1.0% by weight of the softening composition. The minimum amount of the electrolyte will be that amount sufficient to provide the desired viscosity. The dispersions typically display a non-Newtonian rheology, and are shear thinning with a desired viscosity generally ranging from about 10 centipoise (cp) up to about 1000 cp, preferably in the range between about 10 and about 200 cp, as measured at 25° C. and at a shear rate of 100 $sec^{-1}$ using the method described in the TEST Methods section below. Suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. Preferred electrolytes include the chloride salts of sodium, calcium, and magnesium. Calcium chloride is a particularly preferred electrolyte for the softening composition of the present invention. While not being bound by theory, the humectant properties of calcium chloride and the permanent change in equilibrium moisture content which it imparts to the absorbent tissue product to which the composition is applied make calcium chloride particularly preferred. That is, the Applicants believe that the humectant properties of calcium chloride cause it to be a moisture reservoir that can supply moisture to the cellulosic structure of the tissue. As is known in the art, moisture serves as a plasticizer for cellulose. Therefore, the moisture supplied by the hydrated calcium chloride enables the cellulose to be desirably soft over a wider range of environmental relative humidities than similar structures where there is no calcium chloride present. If desired, compatible blends of the various electrolytes are also suitable.

Bilayer Disrupter

The softening composition of the present invention further preferably comprises a bilayer disrupter. While, as has been shown above, the vehicle, particularly the electrolyte thereof, performs a desirable function in preparing the soft tissue paper webs of the present invention, it is desirable also to limit the amount the amount of vehicle deposited onto a tissue web. As noted above, addition of electrolyte allows an increase in the concentration of softening active ingredient in the softening composition without unduly increasing viscosity. However, if too much electrolyte is used, phase separation can occur. The Applicants have found that adding a bilayer disrupter to the softening composition allows more softening active ingredient to be incorporated therein while maintaining viscosity at an acceptable level. As used herein a "bilayer disrupter" is an organic material that, when mixed with a dispersion of a softening active ingredient in a vehicle, is compatible with at least one of the vehicle or the softening active ingredient and causes a reduction of the viscosity of the dispersion.

Not to be bound by theory, it is believed that bilayer disrupters function by penetrating the palliside layer of the liquid crystalline structure of the dispersion of the softening active ingredient in the vehicle and disrupting the order of the liquid crystalline structure. Such disruption is believed to reduce the interfacial tension at the hydrophobic-water interface, thus promoting flexibility with a resulting reduction in viscosity. As used herein, the term "pallisade layer" is meant to describe the area between hydrophilic groups and the first few carbon atoms in the hydrophobic layer (M. J Rosen, Surfactants and interfacial phenomena, Second Edition, pages 125 and 126).

In addition to providing the viscosity reduction benefits discussed above, materials suitable for use as a bilayer disrupter should be compatible with other components of the softening composition. For example, a suitable material should not react with other components of the softening composition so as to cause the softening composition to lose softening capability.

Bilayer disrupters useful in the compositions of the present invention are preferably surface active materials. Such materials comprise both hydrophobic and hydrophilic moieties. A preferred hydrophilic moiety is a polyalkoxylated group, preferably a polyethoxylated group. Such preferred materials are used at a level of between about 2% and about 15% of the level of the softening active ingredient. Preferably, the bilayer disrupter is present at a level of between about 3% and about 10% of the level of the softening active ingredient.

Particularly preferred bilayer disrupters are nonionic surfactants derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with≦50, preferably≦30, more preferably from about 3 to about 15, and even more preferably from about 5 to about 12, ethylene oxide moieties to provide an HLB of from about 6 to about 20, preferably from about 8 to about 18, and more preferably from about 10 to about 15.

Suitable bilayer disrupters also include nonionic surfactants with bulky head groups selected from:

a. surfactants having the formula $$R^1—C(O)—Y'—[C(R^5)]_{m-CH2}O(R_2O)_2H$$

wherein R is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—(CH_2)n—$ and/or $—[CH(CH_3)CH_2]—$; and each $R^5$ is selected from the following groups: —OH; and $—O(R^2O)_z—H$; and m is from about 2 to about 4;

b. surfactants having the formulas: following

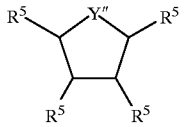

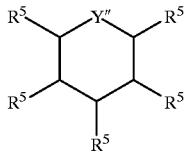

—H, —OH, $—(CH_2)xCH_3$, $—O(OR^2)_z—H$, —OR, —OC(O)$R^1$, and $—CH(CH_2—(OR^2)_z—H)—CH_2—(OR^2)_zC(O)R^1$, x and $R^1$ are as defined above and 5≦z, z', and z"≦20, more preferably 5≦z+z'+z"≦20, and most preferably, the heterocyclic ring is a five member ring with Y'=0, one $R^5$ is —H, two $R^5$ are $—O—(R^2O)z—H$, and at least one $R^5$ is the following structure $—CH(CH_2—(OR^2)_z—H)—CH_2—(OR^2)_z—C(O)R^1$ with 8≦z+z'+z"≦20 and $R^1$ is a hydrocarbon with from 8 to 20 carbon atoms and no aryl group;

c. polyhydroxy fatty acid amide surfactants of the formula:

$$R^2—C(O)—N(R^1)—Z$$

wherein: each $R^1$ is H, $C_1$–$C_4$ hydrocarbyl, $C_1$–$C_4$ alkoxyalkyl, or hydroxyalkyl; and $R^2$ is a $C_5$–$C_{31}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and each R' is H or a cyclic mono- or polysaccharide, or alkoxylated derivative thereof; and Suitable phase stabilizers also include surfactant complexes formed by one surfactant ion being neutralized with surfactant ion of opposite charge or an electrolyte ion that is suitable for reducing dilution viscosity.

Examples of representative bilayer disrupters include:

(1) Alkyl or alkyl-aryl alkoxylated nonionic surfactants

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with≦about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of≦about 30 moles of alkylene oxide per alkyl chain, more preferably from about 3 to about 15 moles of alkylene oxide, and most preferably from about 6 to about 12 moles of alkylene oxide. Preferred materials of this class also have pour points of less than about 70° F. (21° C.) and/or do not solidify in these softening compositions. Examples of alkyl alkoxylated surfactants with straight chains include Neodol® 91-8, 23-5, 25-9, 1-9, 25-12, 1-9, and 45-13 from Shell, Pluraface® B-26 and C-17 from BASF, and Brij® 76 and 35 from ICI Surfactants. Examples of branched alkyl alkoxylated surfactants include Tergitol® 15–S-12, 15–S-15, and 15–S-20 from Union Carbide and Emulphogenee BC-720 and BC-840 from GAF. Examples of alkyl-aryl alkoxylated surfactants include: Surfonic N-120 from Huntsman, Igepale CO-620 and CO-710, from Rhone Poulenc, Tritone® N-111 and N-150 from Union Carbide, Dowfaxe® 9N5 from Dow and Lutensole AP9 and AP14, from BASF.

(2) Alkyl or alkyl-aryl amine or amine oxide nonionic alkoxylated surfactants

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having≦about 50 moles alkylene oxide moieties (e.g. ethylene oxide and/or propylene oxide) per mole of amine. The amine, amide or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of≦50 about moles of alkylene oxide per amine moiety, more preferably from about 3 to about 15 moles of alkylene oxide, and most preferably a single alkylene oxide chain on the amine moiety containing from about 6 to about 12 moles of alkylene oxide per amine moiety. Preferred materials of this class also have pour points less than about 70° F. (21° C.)and/or do not solidify in these softening compositions. Examples of ethoxylated amine surfactants include Berol® 397 and 303 from Rhone Poulenc and Ethomeens® C/20, $C_{25}$, T/25, S/20, S/25 and Ethodumeens® T/20 and T25 from Akzo.

Preferably, the compounds of the alkyl or alkyl-aryl alkoxylated surfactants and alkyl or alkyl-aryl amine, amide, and amine-oxide alkoxylated have the following general formula:

$$R^1{}_m\text{-}Y\text{-}[(R^2\text{—}O)_z\text{—}H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R_2$ is selected from the following groups or combinations of the following groups: —$(CH_2)$n— and/or —[$CH(CH_3)CH_2$]—; wherein about 1≦n≦about 3; Y is selected from the following groups: —O—; —$N(A)_q$—; —C(O)O—; —(O ←)$N(A)_q$—; —B—$R^3$—O; —B—$R^3$—$N(A)_q$—; —B—$R^3$—C(O)O—; —B—$R^3$—N(ΔO)(A)—; and mixtures thereof; wherein A is selected from the following groups: H; $R^1$; —$(R^2\text{—}O)_z$—H; —$(CH_2)_xCH_3$; phenyl, or substituted aryl, wherein 0≦x≦about 3 and B is selected from the following groups: —O—; —N(A)—; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and 5≦z≦30, and q can be 1 or 0, but when p=2, q must be 0; more preferred are structures in which m=1, p=1 or 2, and 7≦z≦20; and even more preferred are structures in which m=1, p=1 or 2, and 9≦z ≦12. The preferred y is 0.

(3) Alkoxylated and non-alkoxylated nonionic surfactants with bulky head groups

Suitable alkoxylated and non-alkoxylated bilayer disrupters with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having≦about 50, preferably≦about 30, moles per mole of heterocyclic or carbohydrate. The hydrocarbon groups on the carbohydrate or heterocyclic surfactant for use herein have from about 6 to about 22 carbon atoms, and are in either straight chain or branched chain configuration, preferably there is one hydrocarbon having from about 8 to about 18 carbon atoms with one or two alkylene oxide chains carbohydrate or heterocyclic moiety with each alkylene oxide chain present in average amounts of≦about 50, preferably≦about 30, moles of carbohydrate or heterocyclic moiety, more preferably from about 3 to about 15 moles of alkylene oxide per alkylene oxide chain, and most preferably between about 6 and about 12 moles of alkylene oxide total per surfactant molecule including alkylene oxide on both the hydrocarbon chain and on the heterocyclic or carbohydrate moiety. Examples of bilayer disrupters in this class are Tween® 40, 60, and 80 available from ICI Surfactants.

Preferably the compounds of the alkoxylated and non-alkoxylated nonionic surfactants with bulky head groups have the following general formulas:

$$R^1\text{—}C(O)\text{—}Y'\text{—}[C(R^5)]_m\text{—}CH_2O(R_2O)_zH$$

wherein R is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $(R^2\text{—}O)_z$—H; —$(CH_2)_xCH_3$; phenyl, or substituted aryl, wherein 0≦x≦about 3 and z is from about 5 to about 30; each $R^2$ is selected from the following groups or combinations of the following groups: —$(CH_2)_n$— and/or —[$CH(CH_3)CH_2$]—; and each $R^5$ is selected from the following groups: —OH; and —$O(R^2O)_z$—H ; and m is from about 2 to about 4;

Another useful general formula for this class of surfactants is

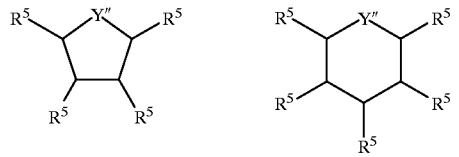

wherein Y"=N or 0; and each $R^5$ is selected independently from the following:

—H, —OH, —$(CH_2)_xCH_3$, —$(OR^2)_z$—H, —$OR^1$, —OC(O)$R^1$, and —$CH_2(CH_2\text{—}(OR^2)_z\text{—}H)\text{—}CH_2\text{—}(OR^2)_z$—C(O) $R^1$. With x R and $R^2$as defined above in w section D above and z, z', and z" are all from about 5≦to≦about 20, more preferably the total number of z+z'+z" is from about 5≦to ≦about 20. In a particularly preferred form of this structure the heterocyclic ring is a five member ring with Y'"O, one $R^5$ is —H, two $R^5$ are —O—$(R^2O)_z$—H, and at least one $R^5$ has the following structure —$CH(CH_2\text{—}(OR^2)_z\text{—}H)\text{—}CH_2\text{—}(OR^2)z\text{—}OC(O)R^1$ with the total z+z'+z"=to from about 8≦to≦about 20 and $R^1$ is a hydrocarbon with from about 8 to about 20 carbon atoms and no aryl group.

Another group of surfactants that can be used are polyhydroxy fatty acid amide surfactants of the formula:

$$R^6\text{—}C(O)\text{—}N(R^7)\text{—}W$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11-C17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof. W preferably will be derived from a reducing sugar in a reductive amination reaction; more preferably W is a glycityl moiety.

W preferably will be selected from the group consisting of —$CH_2$—$(CHOH)_n$—$CH_2OH$, —$CH(CH_2OH)$—$(CHOH)_n$—$CH_2OH$, —$CH_2$—$(CHOH)_2(CHOR')(CHOH)$—$CH_2OH$, where n is an integer from 3 to 5, inclusive, and R' is H or a cyclic mono- or polysaccharide, and alkoxylated derivatives thereof. Most preferred are glycityls wherein n is 4, particularly —$CH_2$—$(CHOH)_4$—$CH_2O$. Mixtures of the above W moieties are desirable.

$R^6$ can be, for example, N-methyl, N-ethyl, N-propyl, N-isopropyl, N-butyl, N-isobutyl, N-2–hydroxyethyl, N-1-methoxypropyl, or N-2-hydroxypropyl.

$R^6$—CO—N<can be, for example, cocamide, stearamide, oleamide, lauramide, myristamide, capricamide, palmitamide, tallowamide, etc.

W can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(4) Alkoxylated cationic quaternary ammonium surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having≦about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than≦about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of≦about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. (21° C.)and/or do not solidify in these softening compositions. Examples of suitable bilayer disrupters of this type include Ethoquade® 18/25, C/25, and O/25 from Akzo and Variquate®-66 (soft tallow alkyl bis (polyoxyethyl) ammonium ethyl sulfate with a total of about 16 ethoxy units) from Witco.

Preferably, the compounds of the ammonium alkoxylated cationic surfactants have the following general formula:

$$\{R^1m—Y—[(R^2—O)_z—H]_p\}^+X^-$$

wherein $R^1$ and $R^2$ are as defined previously in section D above;

Y is selected from the following groups: $=N^+—(A)_q$; $—(CH_2)_n—N^+—(A)_q$; $—B—(CH_2)_n—N^+—(A)_2$; —(phenyl)—$N^+$—$(A)_q$; —(B-phenyl)—$N^+$—$(A)_q$; with n being from about 1 to about 4.

Each A is independently selected from the following groups: H; $R^1$; —$(R^2O)_z$—H; —$(CH_2)_xCH_3$; phenyl, and substituted aryl; where 0≦x≦about 3; and B is selected from the following groups: —O—; —NA—; —$NA_2$; —C(O)O—; and —C(O)N(A)—; wherein $R^2$ is defined as herein before; q=1 or 2; and $X^+$ is an anion which is compatible with fabric softener actives and adjunct ingredients.

Preferred structures are those in which m=1, p=1 or 2, and about 5≦z≦about 50, more preferred are structures in which m=1, p=1 or 2, and about 7≦z≦about 20, and most preferred are structures in which m=1, p=1 or 2, and about 9≦z≦about 12.

(5) Alkyl amide alkoxylated nonionic surfactants

Suitable surfactants have the formula:

$$R—C(O)—N(R^4)_n—[(R^1O)_x(R^2O)_yR^3]_m$$

wherein R is $C_{7-21}$ linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl.

$R^1$ is —$CH_2$—CH2—, $R_2$ is $C_3$–$C_4$ linear alkyl, $C_3$–$C_4$ branched alkyl, and mixtures thereof; preferably $R^2$ is —$CH(CH_3)$—$CH_2$—. Surfactants which comprise a mixture of R1 and R2 units preferably comprise from about 4 to about 12 —$CH_2$—$CH_2$— units in combination with from about 1 to about 4 —$CH(CH_3)$—$CH_2$— units. The units may be alternating or grouped together in any combination suitable to the formulator. Preferably the ratio of $R^1$ units to $R^2$ units is from about 4:1 to about 8:1. Preferably an $R^2$ unit (i.e. —$C(CH_3)H$—$CH_2$—) is attached to the nitrogen atom followed by the balance of the chain comprising from about 4 to 8 —$CH_2$—$CH_2$— units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R_4$ unit is absent.

The index m is 1 or 2, the index n is 0 or 1, provided that m+n equals 2; preferably m is equal to 1 and n is equal to 1, resulting in one —$[(R^1O)_x(R^2)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Witco, Amidoxe $C_5$ from Stepan, and Ethomide® O/17 and Ethomide® HT/60 from Akzo.

Minor Components of the Softening Composition

The vehicle of a preferred softening composition of the present invention can also comprise minor ingredients as may be known to the art. Examples include: mineral acids or buffer systems for pH adjustment (may be required to maintain hydrolytic stability for certain softening active ingredients) and antifoam ingredients (e. g., a silicone emulsion as is available from Dow Corning, Corp. of Midland, Mich. as Dow Corning 2310) as a processing aid to reduce foaming when the softening composition of the present invention is applied to a web of tissue.

Stabilizers may also be used to improve the uniformity and shelf life of the dispersion. For example, an ethoxylated polyester, HOE S 4060, available from Clariant Corporation of Charlotte, N.C. may be included for this purpose.

Process aids may also be used, including for example, a brightener, such as Tinopal CBS-X, obtainable from CIBA-GEIGY of Greensboro, N.C. may be added to the dispersion to allow easy qualitative viewing of the application uniformity, via inspection of the finished tissue web, containing a surface-applied softening composition, under UV light.

Forming the Softening Composition

As noted above, the preferred softening composition suitable for present invention is a dispersion of a softening active ingredient in a vehicle. Depending on the softening active ingredient chosen, the desired application level and other factors as may require a particular level of softening active ingredient in the composition, the level of softening active ingredient may vary between about 10% of the composition and about 55% of the composition. Preferably, the softening active ingredient comprises between about 25% and about 50% of the composition. Most preferably, the softening active ingredient comprises between about 30% and about 45% of the composition. The nonionic surfactant is present at a level between about 1% and about 15% of the level of the softening active ingredient, preferably between about 2% and about 10%. Depending on the method used to produce the softening active ingredient the softening composition may also comprise between about 2% and about 30%, preferably between about 5% and about 25% of a plasticizer. As noted above, the preferred primary component of the vehicle is water. In addition, the vehicle preferably comprises an alkali or alkaline earth halide electrolyte and may comprise minor ingredients to adjust pH, to control foam, or to aid in stability of the dispersion.

A particularly preferred softening composition useful for the present invention (Composition 1) is prepared as follows. The materials are more specifically defined in the table detailing Composition 1 which follows this description. Amounts used in each step are sufficient to result in the finished composition detailed in that table. The hydrochloric acid (25% solution), antifoam ingredient and nonionic surfactant are added to the appropriate quantity of water. This mixture is then heated to about 165° F. (75° C.). Concurrently with heating the water mixture, the blend of softening active ingredient and plasticizer is melted by heating it to a temperature of about 150° F. (65° C). The melted mixture of softening active ingredient and plasticizer is then slowly added to the heated acidic aqueous phase with mixing to evenly distribute the disperse phase throughout the vehicle. (The water solubility of the polyethylene glycol probably carries it into the continuous phase, but this is not essential to the invention and plasticizers which are more hydrophobic and thus remain associated with the alkyl chains of the quaternary ammonium compound are also allowed within the scope of the present invention.) Once the softening active ingredient is thoroughly dispersed, part of the calcium chloride is added (as a 2.5% solution) intermittently with mixing to provide an initial viscosity reduction. The stabilizer is then added to the mixture with continued agitation. Any of the methods of homogenizing dispersions can be used for this purpose. An acceptable method of homogenizing a 40 gallon quantity of the softening composition it to use a Ultra-Turrax, model T45 S4 homogenizer, available from Tekmar Company of Cincinnati, Ohio, immersed in the material for a period of 4 hours. The composition is then allowed to cool to room temperature and the stabilizer is slowly added with mixing. Lastly, the remainder of the calcium chloride(as a 25% solution) and makeup water are added with continued mixing.

Composition 1

| Component | Concentration |
|---|---|
| Continuous Phase | |
| Water | QS to 100% |
| Electrolyte[1] | 0.5% |
| Antifoam[2] | 0.2% |
| Bilayer Disrupter[3] | 2.0% |
| Hydrochloric Acid[4] | 0.02% |
| Plasticizer[5] | 19% |
| Brightener[6] | 89 ppm |
| Stabilizer[7] | 0.5% |
| Disperse Phase | |
| Softening Active Ingredient[5] | 40.0% |

[1]Electrolyte comprises 0.34% from 2.5% aqueous calcium chloride solution and 0.16% from 25% aqueous calcium chloride solution is this right
[2]Antifoam comprises Silicone Emulsion—Dow Corning 2310 ®, marketed by Dow Corning Corp., Midland, MI
[3]Bilayer Disrupter comprises suitable nonionic surfactants, available from Shell Chemical of Houston, TX under the trade name NEODOL.
[4]Hydrochloric Acid is available from J. T. Baker Chemical Company of Phillipsburg, NJ
[5]Plasticizer and softening active ingredient are pre-blended by Witco Chemical Company of Dublin OH, blend comprises about 2 parts tallow diester quaternary (Adogen SDMC-type) and 1 part polyethylene glycol 400.
[6]Brightener is Tinopal CBS-X, obtainable from CIBA-GEIGY of Greensboro, NC.
[7]Stabilizer is HOE S 4060, from Clariant Corp., Charlotte, NC The resulting chemical softening composition is a milky, low viscosity dispersion suitable for application to tissue webs as described below for providing desirable tactile softness to tissue paper produced from such webs. It displays a shear-thinning non-Newtonian viscosity. Suitably, the composition has a viscosity less than about 1000 centipoise (cp), as measured at 25° C. and at a shear rate of 100 $sec^{-1}$ using the method described in the TEST METHODS section below. Preferably, the composition has a viscosity less than about 500 cp. More preferably, the viscosity is less than about 100 cp.

Application Method

In one preferred embodiment of the present invention, the preferred softening composition may be applied to a tissue web after the tissue web has been dried and creped.

Figure 2:
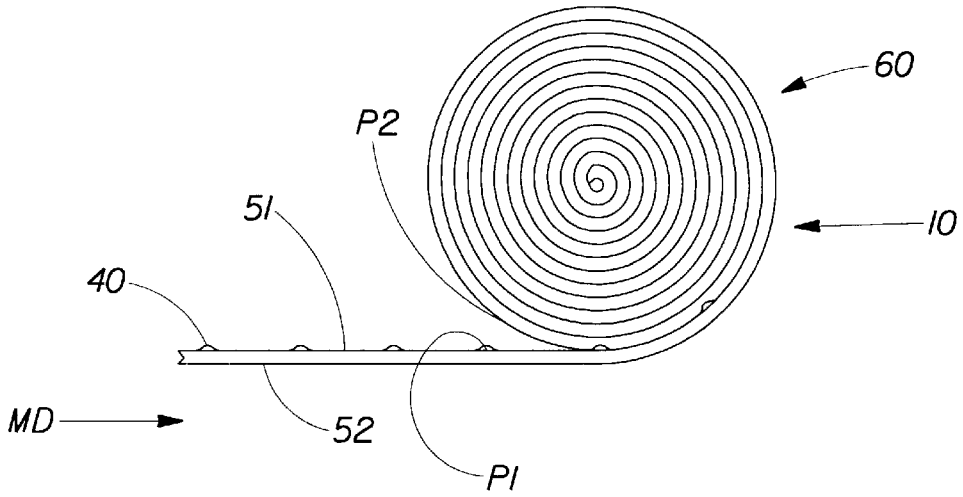
FIG. 2 is a partial and more detailed side view of the process and a paper product of the present invention.

The first step of the process comprises providing a fibrous web 50, as described above. The web 50 has a first side 51 and a second side 52 opposite to the first side 51, as shown in FIGS. 1–3. It is to be understood that the web 50 may comprise a multi-ply structure, for example, a two-ply structure. In this instance, the first side 51 belongs to one of the plies while the second side 52 belongs to the other. The functional chemical additive (or "chemical additive," or simply "additive") 40 is also provided as described above. Preferably, the chemical additive is selected from the group consisting of softeners, emulsions, emollients, lotions, topical medicines, soaps, anti-microbial and anti-bacterial agents, moisturizers, coatings, inks and dyes, strength additives, absorbency additives, binders, opacity agents, fillers, and combinations thereof.

If the additive comprises the softener, the softener additive may be selected from the group consisting of lubricants, plasticizers, cationic debonders, noncationic debonders, and mixtures thereof. The softener may also be selected from the group consisting of quaternary ammonium compounds, tertiary ammonium compounds, polysiloxane compounds, and mixtures thereof.

If the additive comprises the strength additive, the strength additive may be selected from the group consisting of permanent wet-strength resins, temporary wet-strength resins, dry-strength resins, and mixtures thereof.

If the additive comprises the absorbency additive, the absorbency additive may be selected from the group consisting of polyethoxylates, alkylethoxylated esters, alkylethoxylated alcohols, alkylpolyethoxylated nonylphenols, and mixtures thereof.

Figure 7:
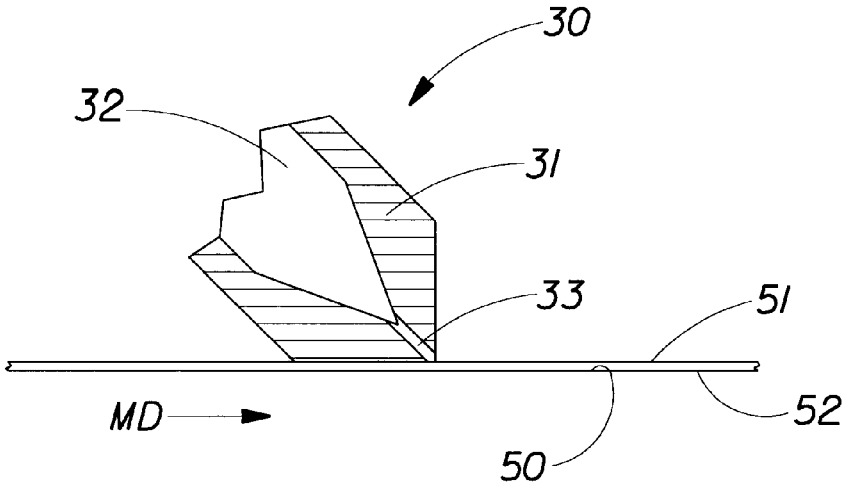
FIG. 7 is a schematic cross-sectional view of an extrusion die in conjunction with the web.

The chemical additive 40 is deposited to the first side 51 of the fibrous web 50. The preferred methods of the step of depositing the chemical additive to the first side of the web comprise extrusion coating, spray coating, print coating, and any combination thereof. In the extrusion coating, the use of a jet extrusion die 30 shown in FIG. 7 was found to be beneficial. The jet extrusion die 30 comprises a body 31, an internal fluid reservoir 32, and a pre-jet channel 33. Commonly assigned patent application 09/258,497 (P&G Case No. 7447), filed on Feb. 26, 1999 is incorporated by reference herein.

Figure 8:
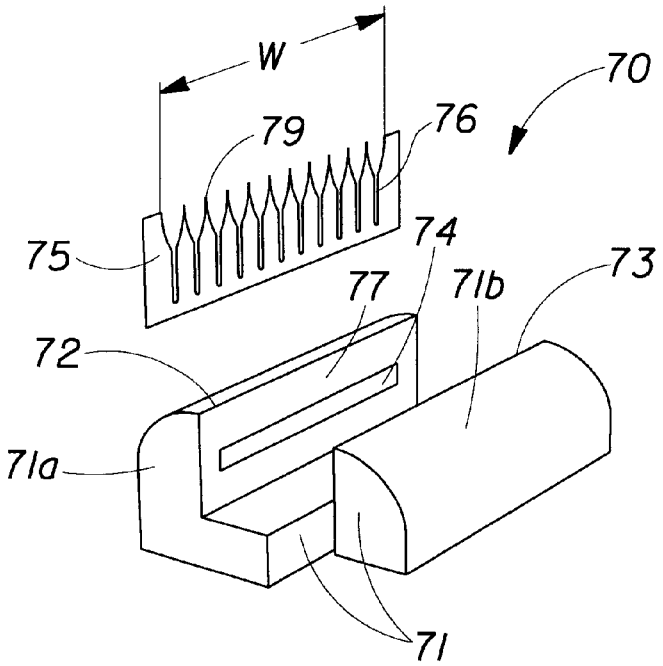
FIG. 8 is a schematic perspective view of another extrusion die which can be used in the present invention; the extrusion die is shown partially-disassembled.

Another extrusion die, designated 70 and shown in FIG. 8, is also suitable in the practice of the present invention. This die comprises a body 71 having a cavity therein and at least one replaceable shim 75 sized to fit into the cavity. Preferably, the body 71 is formed by a pair of portions 71*a* and 71*b* structured to clamp the shim 75 therebetween. The shim 75 comprises a plurality of slots 76 therethrough, each slot having one open end. A distribution channel 74 in one of the portions 71*a*, 71*b* receives the additive 40. When the shim 75 is within the body 71, each of the slits 76 and abutting the shim surfaces of the portions 71*a*, 71*b* form a channel structured to provide fluid communication between the distribution channel 74 and an outlet formed between outlet lips 72, 73. In one embodiment, the slits 76 provide discrete beads of the additive 40. In another embodiment, the open ends of the slits 76 are flared to facilitate widening of the additive 40 before the additive 40 is deposited onto the first side 51 of the web 50. Further, an edge (or side) 79 of the shim (and thus the open ends of the slits 76) may be recessed relative at least one of to the outlet lips 72, 73, such as to cause the individual streams of the additive 40 to connect right after exiting the flow channels formed by the slits 76 and before being deposited onto the first side 51 of the web 50. Commonly assigned patent applications 09/258,511 (P&G Case No. 7391) and 09/258,498 (P&G Case No. 7392), filed on Feb. 26, 1999 are incorporated by reference herein.

Methods of applying the functional additive 40, such as softening composition, to the web 50 may also include spraying and printing. In one preferred aspect of the present invention, spraying of the dispersed softening composition is accomplished by utilizing a transfer surface. The dispersed softening composition is spray-applied to the transfer surface after which the transfer surface is brought into contact with a dried tissue web before said web is wound into the parent roll. A particularly convenient means of accomplishing this application is to apply the softening composition to one or both of a pair of calendering rolls which, in addition to serving as transfer surfaces for the present softening composition, also serve to reduce and control the thickness of the dried tissue web to the desired caliper of the finished product.

Figure 9:
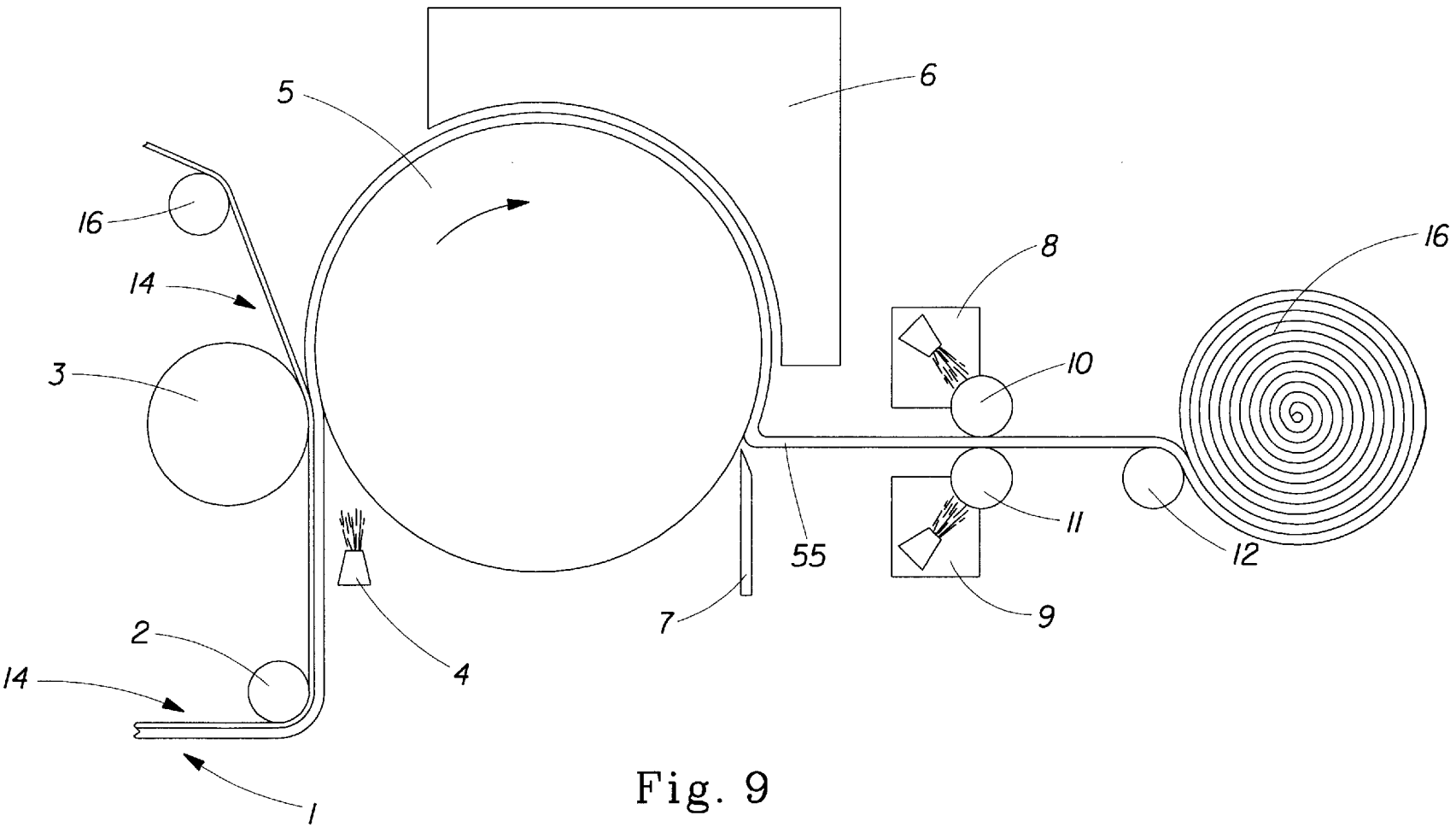
FIG. 9 is a schematic representation of one embodiment of the process of the present invention.

FIG. 9 shows one method of applying the softening composition to the tissue web 50. A wet tissue web 50 is on carrier fabric 14 past turning roll 2 and transferred to Yankee dryer 5 by the action of pressure roll 3 while carrier fabric 14 travels past turning roll 16. The web is adhesively secured to the cylindrical surface of Yankee dryer 5. An adhesive may be applied by a spray applicator 4. Drying is completed by steam-heated Yankee dryer 5 and by hot air which is heated and circulated through drying hood 6 by means not shown. The web 55 is then dry-creped from the Yankee dryer 5 by doctor blade 7, after which it is designated creped paper sheet 55. The softening composition of the present invention is sprayed onto an upper transfer surface designated as upper calendering roll 10 and/or a lower transfer surface designated as lower calendering roll 11, by spray applicators 8 and 9 depending on whether the softening composition is to be applied to both sides of the tissue web or just to one side. The paper sheet 55 then contacts transfer surfaces 10 and 11. A portion of the vehicle can be evaporated, if desired, in this process by providing means to heat one or both of the transfer surfaces. The treated web 55 then travels over a circumferential portion of reel 12, and then is wound onto parent roll 16.

Exemplary materials suitable for the transfer surfaces 10, 11 include metal (e.g., steel, stainless steel, and chrome), non-metal (e.g., suitable polymers, ceramic, glass), and rubber. Equipment suitable for spraying softening composition of the present invention onto transfer surfaces include external mix, air atomizing nozzles, such as SU14 air atomizing nozzles (Air cap #73328 and Fluid cap #2850) of Spraying Systems Co. of Wheaton, Ill. Equipment suitable for printing softening composition-containing liquids onto transfer surfaces include rotogravure or flexographic printers.

If heating is provided to the transfer surface, the temperature of the heated transfer surface is preferably maintained below the boiling point of the softening composition. Thus, if the predominant component of the vehicle is water, the temperature of the heated transfer surface should be below 100° C. Preferably the temperature is between 50 and 90° C., more preferably between 70° and 90° C. when water is used as the predominant component of the vehicle and heating the transfer surface is desired.

While not wishing to be bound by theory or to otherwise limit the present invention, the Applicants provide the following description of typical process conditions encountered during the papermaking operation and their impact on one of the preferred processes described in this invention is provided. The Yankee dryer raises the temperature of the tissue sheet and removes the moisture. The steam pressure in the Yankee is on the order of 110 PSI (750 kPa). This pressure is sufficient to increase the temperature of the cylinder to about 170° C. The temperature of the paper on the cylinder is raised as the water in the sheet is removed. The temperature of the sheet as it leaves the doctor blade can be in excess of 120° C. The sheet travels through space to the calender and the reel and loses some of this heat. The temperature of the paper wound in the reel is on the order of 60° C. Eventually the sheet of paper cools to room temperature. This can take anywhere from hours to days depending on the size of the paper roll. As the paper cools it also absorbs moisture from the atmosphere.

Since the softening composition of the present invention Is preferably applied to the paper while it is overdried, the water added to the paper with the softening composition by this method is not sufficient to cause the paper to lose a significant amount of its strength and thickness. Thus, no further drying is required.

Alternatively, effective amounts of softening active ingredients from the softening compositions of the present invention may also applied to a tissue web that has cooled after initial drying and has come into moisture equilibrium with its environment. The method of applying the softening compositions of the present invention is substantially the same as that described above for application of such compositions to a hot, overdried tissue web. That is, the softening composition may be applied to a transfer surface which then applies the composition to the tissue web. It is not necessary for such transfer surfaces to be heated because the desirable Theological properties of the preferred softening composition of the present invention allow even application across the full width of a tissue web. Again, the softening composition is preferably applied to a transfer surface in a macroscopically uniform fashion for subsequent transfer to the tissue paper web so that substantially the entire sheet benefits from the effect of the softening composition. Suitable transfer surfaces include patterned printing rolls, engraved transfer rolls (Anilox rolls), and smooth rolls that may be part of an apparatus specifically designed to apply the softening composition or part of an apparatus designed for other functions with respect to the tissue web. An example of means suitable for applying the softening composition of the present invention to an environmentally equilibrated tissue web is the gravure cylinders and printing method described in commonly assigned U.S. Pat. No. 5,814,188, issued to Vinson et al. on Sep. 29, 1998, the disclosure of which is incorporated herein by reference. Also, as noted above, the softening composition of the present invention could be applied to a smooth roll (e. g. by spraying one of a nip pair) of an apparatus designed for other functions (e. g. converting the tissue web into a finished absorbent tissue product).

While not being bound by theory, the Applicants believe that the softening compositions preferred for practice of the present invention are particularly suitable for application to environmentally equilibrated tissue webs because:

1. Such softening compositions comprise high levels of softening active ingredients and other nonvolatile components. As a result, the amount of water carried to the tissue web by such softening composition is low. For example, when th ferred composition referred to as Composition 1 herein is applied to a tissue web at a level providing 0.5% softening active, about 0.5% water is also applied to the web. The Applicants have found that such webs are still acceptably strong and dimensionally stable.

and

2. The hygroscopic properties of the preferred electrolyte, calcium chloride, bind at least a portion of the water in the composition so it is not available for unacceptably lowering the tensile properties of the treated web.

When webs have been treated as described above and then evaluated for softness, they have been found to have significant softness improvement as judged in softness panels, the methodology for which can be found in the Test Methods section of the present specification.

The next step comprises causing the first side 51 of the fibrous web 50 to contact the second side 52 of the fibrous web 50, thereby partially transferring the chemical additive 40 from the first side 51 to the second side 52 such that both the first side 51 and the second side 52 of the fibrous web 50 comprise the chemical additive 40 in a functionally sufficient amount. As used herein, the term "functionally sufficient amount" refers to such an amount of the chemical additive, which amount causes the web 50 to acquire the qualities for which the deposition of the chemical additive is intended. In the instance of the additive 40 comprising a softener, the functionally sufficient amount is preferably at least 0.05 gram per square meter of the web 50, more preferably at least 0.1 gram per square meter, and most preferably at least about 0.15 gram per square meter of the web.

Preferably, the step of causing the first side to contact the second side of the fibrous web and transferring the chemical additive from the first side to the second side comprises continuously winding the fibrous web 50 into a roll 60, as shown in FIGS. 1 and 2. When the web 50 is being wound into the roll 60, the chemical additive 40 is transferred from a first position P1 on the first side 51 of the fibrous web 50 to a second position P2 on the second side 52 of the fibrous web 50, the second position P2 being off-set from the first position P1 relative to a plan of the web 50. Preferably, the web 50 is continuously traveling in a machine direction MD at a transport velocity. Then, the second position P2 on the second side of the fibrous web is off-set in the machine direction MD from the first position P1 on the first side of the fibrous web. One skilled in the art will appreciate that an extent of the off-set can be measured as a length of a curve (or circle) formed by a portion of the web 59, between the first position P1 and the second position P2 (FIG. 2). As used herein, the term "machine direction," designated in several drawings as a directional arrow "MD," indicates a direction which is parallel to the flow of the substrate 50 through the papermaking equipment. The term "cross-machine direction," designated as a directional arrow "CD," indicates a direction which is perpendicular to the machine direction MD and lies in the general plane of the substrate 50.

It is believed that when the web 50 is being wound into the roll, shearing forces existing between the first side 51 and the second side 52 of the web 50 the point of contact (e. g. between the first portion P1 and the second portion P2) facilitate the transferal of the functional additive 40 from the first side 51 the second side 52 of the web 50.

According to the present invention, the amount of the chemical additive 40 transferred from the first side 51 of the fibrous web 50 to the second side 52 of the fibrous web 52 is such that a ratio (designated herein as "R") of a surface concentration SC2 of the chemical additive 40 on the second side 52 to the surface concentration SC1 of the chemical additive 40 on the first side 51 is preferably at least 1:4, more preferably at least about 1:2, and most preferably about 1:1. Stated differently, as a result of the transferal of the chemical additive 40 from the first side 51 to the second side 52 of the web 50, at least about 20%, preferably at least about 33%, and more preferably about 50%, of the additive 40 is transferred from the first side 51 to the second side 52 of the web 50, according to the process of the present invention. As used herein, the "surface concentration" of the functional chemical additive 40 is determined by use of a Sutherland Rub Tester, as described herein below in the Test Methods section.

In order to transfer the functionally sufficient amount of the chemical additive 40 from the first side 51 to the second side 52 of the web 50, it is important to maintain the chemical additive 40 in a transferable condition prior to and during the step of causing the first side 51 to contact the second side 52. One means of maintaining the chemical additive 40 in the transferable condition comprises maintaining a sufficient viscosity of the additive 40 such that when the first side 51 contacts the second side 52, the first side 51 has not absorbed the entire amount of the additive 40 deposited thereto, and a sufficient portion of the additive 40 is "free" from the fibers of the first side 51 and transferable by contact.

One skilled in the art will know a variety of ways by which the viscosity of a fluid can be influenced. For example, viscosity can be raised by reducing temperature of the fluid. In a softening composition of the present invention, the viscosity can be beneficially raised by decreasing the amount of the vehicle and/or increasing the amount of solids contained therein. Also, decreasing the shear rate experienced by the additive 40 (dependent on the process of application) would decrease the viscosity of the additive 40, provided additive 40 displays thixotropic properties as many functional chemical additives display, including the preferred chemical softening composition of the present invention.

Surface porosity of the web 50 may also influence the ability to maintain the chemical additive 40 in a transferable condition. "Surface porosity" as used herein refers to the average capillary size formed by the network fiber structure of tissue web of the present invention as viewed in plan view directed at the first side 51 of the web. Surface porosity is reduced if the mean capillary size is reduced and raised if mean capillary size is raised. Those skilled in the art will recognize that it is preferred to have a low surface porosity to best maintain chemical additive 40 in a transferable condition provided all other process conditions are held constant.

As used herein, the term "open time" (OP) refers to the time elapsed between deposition of a functional chemical additive 40 and transferal of the functional chemical additive 40 from the first side 51 to the second side 52 of the fibrous web 50. For a fibrous web being carried continuously in the machine direction MD, the open time is determined by dividing the web speed into the distance separating the depositor and the transferal point (normally the reel). Thus, the invention is promoted by minimizing the depositor-to-transferal distance and maximizing the web speed. "Drop Absorbency Time" (DAT) is the time elapsed for a small drop of the functional chemical additive 40 to be adsorbed into the first surface 51 of the fibrous web 50. The method of determining Drop Absorbency Time is detailed in the Test Methods section of the present specification. The Drop Absorbency Time is a useful measure to select the characteristics of the functional chemical additive and the surface characteristics of the fibrous web to co-operate with the open time to provide for transferal of a functionally sufficient amount of the chemical additive. The open time for the functional additive 40 comprising softener, according to the present invention, is preferably less than about 1 second, more preferably less than about 0.1 seconds, still more preferably less than about 0.05 seconds, and most preferably, less than about 0.015 seconds.

The term "Surface Concentration" (SC) of the functional chemical additive 40 is the concentration of a functional chemical additive 40 determined in the fibers residing at the surface of a fibrous web, as described in the Test Methods section of the present specification. The method is referred to as the "Surface Concentration of Functional Chemical Additive". Determination is by means of a Sutherland Rub Tester which is used to abrade the surface of a fibrous web employing a standard felt, removing a portion of the fibers abraded from the surface and analyzing the fibers removed for the concentration of a known functional chemical additive.

Determination of quaternary paper softener content is done as described in the method: "Softening Active Ingredient Level" provided in the Test Methods section of the present specification. The method is applicable to entire paper samples or to samples for fiber recovered in the "Surface Concentration of a Functional Chemical Additive Analysis" method, which is also provided within the Test Methods section of the present specification.

The chemical functional additives described above may be applied to a transfer surface which then applies the composition to the tissue paper web. The softening composition should be applied to the transfer surface in a macroscopically uniform fashion for subsequent transfer to the tissue paper web so that substantially the entire sheet benefits from the effect of the chemical functional additive. Following application to the transfer surface, a portion of the volatile components of the vehicle evaporates leaving preferably a deposit containing any remaining unevaporated portion of the volatile components of the vehicle, the active ingredients of the chemical functional additive, and other nonvolatile components of the chemical functional additive. A "deposit" refers to discrete elements as well as a continuous thin film. If the deposits are discrete, they can be of uniform size or varying in size; further they may be arranged in a regular pattern or in an irregular pattern, but macroscopically the deposits are uniform. Preferably the deposit is composed of discrete elements.

EXAMPLES

Example 1

Example 1 illustrates preparation of tissue paper exhibiting at least one embodiment of the present invention. This example demonstrates the production of a layered tissue paper web that is provided with a preferred softening composition and a preferred application process of the present invention made as described above. The composition by its respective application process is applied to one side of the web, and the web is then wound forming a parent roll. Upon contact, the softening composition is transferred from one side of the web to the other in a functionally sufficient amount.

A Fourdrinier papermaking machine is used in the practice of the present invention.

An aqueous slurry of eucalyptus fibers of about 3% by weight is made up using a conventional repulper and is passed through a stock pipe toward the headbox of the Fourdrinier.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® is prepared and is added to the NSK and eucalyptus stock pipes at a rate sufficient to deliver about 0.3% Parez 750® based on the dry weight of the final creped dry web. The absorption of the temporary wet strength resin is enhanced by turbulent mixing of the treated slurries.

The streams of NSK fibers and eucalyptus fibers are then diluted with white water at the inlet of fan pumps to a consistency of about 0.2% based on the total weight of the NSK fibers and eucalyptus fibers respectively. The eucalyptus stream is equally split into two separate streams prior to being diluted with white water near the inlet of two separate fan pumps.

The separate dilute post-fan pump slurries of NSK fibers and eucalyptus fibers are directed into a multi-channeled headbox suitably equipped to maintain separate streams until discharged onto a traveling Fourdrinier wire, wherein one of the eucalyptus streams is the top most stream, the NSK stream is the middle most stream, and the second eucalyptus stream is the bottom most stream. The separate streams are discharged onto the traveling Fourdrinier wire and are dewatered through the Fourdrinier wire and is assisted by a deflector and vacuum boxes.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 7 mil above the supporting fabric. The knuckle area is about 40% and the open cells remain at a frequency of about 72 per square inch.

Further dewatering is accomplished by vacuum assisted drainage until the web has a fiber consistency of about 28%.

While remaining in contact with the patterned forming fabric, the patterned web is pre-dried by air blow-through predryers to a fiber consistency of about 62% by weight.

The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 3000 fpm (feet per minute) (about 1000 meters per minute).

The web is then wound producing a parent roll at a percent crepe of about 18%. One skilled in the art would appreciate that the term "percent crepe" refers to a velocity differential between the reel and the Yankee.

The parent roll is then unwound, and surface modified with a chemical softening mixture, and then wound again.

Materials used in the preparation of the chemical softening mixture are:

1. Partially hydrogenated tallow diester chloride quaternary ammonium compound premixed with polyethylene glycol 400 and Neodol 91-8. The premix is 68% quaternary ammonium compound obtained from Witco Corporation as ADOGEN SDMC-type quat, and 30% PEG400 (available from J. T. Baker Company of Phillipsburg, NG), and about 2% Neodol (available from Shell chemical company of Houston, Tex.).

3. Calcium Chloride Pellets from J. T. Baker Company of Phillipsburg, N.J.

4. Polydimethylsiloxane ($DC_{2310}$) from Dow Corning of Midland, Mich.

5. Hydrochloric acid from J. T. Baker Company of Phillipsburg, N.J.

6. Brightener is Tinopal CBS-X, obtainable from CIBA-GEIGY of Greensboro, N.C.

7. Stabilizer is HOE S 4060, from Clariant Corp., Charlotte, N.C.

These materials are prepared as follows to form the softening composition of the present invention.

The chemical softening composition is prepared by adding the brightener, and the polydimethylsiloxane to the required quantity of deionized water. The solution is then adjusted to pH of about 4 using hydrochloric acid. The resultant mixture is heated to about 75° C. The premix of quaternary compound PEG 400, and Neodol 91-8 is then heated to about 65° C. and metered into the water premix with stirring until the mixture is fully homogeneous. About half of the calcium chloride is added as a 2.5% solution in water with continued stirring. The stabilizer is then added with continued mixing. Final viscosity reduction is achieved by adding the remainder of the calcium chloride (as a 25% solution) with continued mixing. The components are blended in a proportion sufficient to provide a composition having the following approximate concentrations:

40% Partially hydrogenated tallow diester chloride quaternary ammonium compound;

39% Water;

19% PEG 400;

1% Neodol 91-8;

0.5% $CaCl_2$;

0.5% Stabilizer;

0.2% Polydimethylsiloxane;

0.02% HCI;

98ppm Brightener;

After cooling and addition of make-up water, the composition has a viscosity of about 200 cp as measured at 250° C. and at a shear rate of 100 $sec^{-1}$ using the method described in the TEST METHODS section.

The chemical softening composition is transferred to the web by a jet extrusion die. The die is cut such that the tip of the die forms a knife edge, wherein the angle between the two faces which form the knife edge is about 90 degrees. The distance between the tip of the knife edge and the internal reservoir containing the chemical softening composition is about 0.010 inches. Holes are then drilled through the tip of the knife edge and into the internal fluid reservoir with a mean length of about 0.010 inches forming the prejet channel and a diameter of about 0.008 inches. The spacing of the holes from center-to-center is about 0.010 inches across the knife edge of the jet extrusion die, wherein the knife edge of the extrusion die is aligned in the cross machine direction of the web.

The chemical softening composition in the internal fluid reservoir 32 (FIG. 7) of the jet extrusion die 30 is pressurized with respect to the exit of the of the prejet channel 33, such that the fluid will flow into, through, and then out of the prejet channel 33 forming a jet at a flow rate of about 5.2 milliliters per minute per hole. The jet moves through the air in a direction that is 45 degrees in the machine direction with respect to the plane of the web. The basis weight of the web 50 is about 22 pounds per 3000 square feet. The jet travels about 0.5 inches after exiting the jet die tip until it contacts the web, wherein it forms a proud deposit on top of the web. The web 50 then travels in machine direction MD towards the winder for an open time of about 0.25 seconds.

Separately, the combination of the described web and the softening composition are evaluated for Drop Absorbency Time (DAT). The DAT value is about 2.5 seconds; therefore the ratio of open time to DAT is about 0.1.

The web 50 containing the chemical softening composition is wound into a parent roll such that the side containing the chemical softening composition (the first side 51) does not come in contact with the winder surface, but rather comes in contact with the web surface (the second side 52) that is on the winding parent roll.

The web is converted into a layered single-ply creped patterned densified tissue paper product with functionally sufficient amounts of chemical softening composition on both sides 51, 52 of the web 50. The resulting treated tissue paper has an improved tactile sense of w softness relative to the untreated control.

The table below illustrates the surface concentration of the chemical softness composition on the second side 52 relative to that on the first side 51.

Example 2

Example 2 illustrates preparation of tissue paper exhibiting at least one embodiment of the present invention. This example demonstrates the production of a layered tissue paper web that is provided with a preferred softening composition and a preferred application process of the present invention made as described above. The composition by its respective application process is applied to one side of the web and the web is then wound forming a parent roll.

A pilot scale Fourdrinier papermaking machine is used in the practice of the present invention.

An aqueous slurry of eucalyptus fibers of about 3% by weight is made up using a conventional repulper and is passed through a stock pipe toward the headbox of the Fourdrinier.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® is prepared and is added to the NSK stock pipe at a rate sufficient to deliver about 0.3% Parez 750® based on the dry weight of the final creped dry web. The absorption of the temporary wet strength resin is enhanced by passing the treated slurry through an in-line mixer.

The separate streams of NSK fibers and eucalyptus fibers are then diluted with white water at the inlet of their separate respective fan pumps to a consistency of about 0.2% based on the total weight of the NSK fibers and eucalyptus fibers respectively. The post-fan pump eucalyptus fiber stream is equally split into two separate streams.

The separate post-fan pump slurries of NSK fibers and eucalyptus fibers are directed into a multi-channeled headbox suitably equipped to maintain separate streams until discharged onto a traveling Fourdrinier wire, wherein one of the eucalyptus streams is the top most stream, the NSK stream is the middle most stream, and the second eucalyptus stream is the bottom most stream. The separate streams are discharged onto the traveling Fourdrinier wire and are dewatered through the Fourdrinier wire and are assisted by a deflector and vacuum boxes forming an embryonic wet web.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 7 mil above the supporting fabric. The knuckle area is about 40% and the open cells remain at a frequency of about 72 per square inch.

Further dewatering is accomplished by vacuum assisted drainage until the web has a fiber consistency of about 28%.

While remaining in contact with the patterned forming fabric, the patterned web is pre-dried by air blow-through predryers to a fiber consistency of about 62% by weight.

The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 250 meters per minute).

The parent roll is then surface modified with a chemical softening mixture, and then wound into a parent roll.

Materials used in the preparation of the chemical softening mixture are:

1. Partially hydrogenated tallow diester chloride quaternary ammonium compound premixed with polyethylene glycol 400 and Neodol 91-8. The premix is 68% quaternary ammonium compound available from Witco Corporation as ADOGEN SDMC-type quat, and 30% PEG400 (available from J. T. Baker Company of Phillipsburg, NG), and about 2% Neodol (available from Shell chemical company of Houston, Tex.).

3. Calcium Chloride Pellets from J. T. Baker Company of Phillipsburg, N.J.

4. Polydimethylsiloxane ($DC_{2310}$) from Dow Corning of Midland, Mich.

5. Hydrochloric acid from J. T. Baker Company of Phillipsburg, N.J.

6. Brightener is Tinopal CBS-X, obtainable from CIBA-GEIGY of Greensboro, N.C.

7. Stabilizer is HOE S 4060, from Clariant Corp., Charlotte, N.C.

These materials are prepared as follows to form the softening composition of the present invention.

The chemical softening composition is prepared by adding the brightener, and the polydimethylsiloxane to the required quantity of deionized water. The solution is then adjusted to pH of about 4 using hydrochloric acid. The resultant mixture is heated to about 75° C. The premix of quaternary compound PEG 400, and Neodol 91-8 is then heated to about 65° C. and metered into the water premix with stirring until the mixture is fully homogeneous. About half of the calcium chloride is added as a 2.5% solution in water with continued stirring. The stabilizer is then added with continued mixing. Final viscosity reduction is achieved by adding the remainder of the calcium chloride (as a 25% solution) with continued mixing. The components are blended in a proportion sufficient to provide a composition having the following approximate concentrations:

40% Partially hydrogenated tallow diester chloride quaternary ammonium compound;

39% Water;

19% PEG 400;

1% Neodol 91-8;

0.5% $CaCl_2$;

0.5% Stabilizer;

0.2% Polydimethylsiloxane;

0.02% HCl;

98 ppm Brightener.

After cooling and addition of make-up water, the composition has a viscosity of about 200 cp as measured at 25°

C. and at a shear rate of 100 $sec^{-1}$ using the method described in the TEST METHODS section.

The chemical softening composition is transferred to the web by a slot extrusion die. The web first comes in contact with the leading edge of the slot extrusion die; the leading edge has a length of about 0.25 inches and the angle of web wrap about the leading edge is about 5 degrees. The web comes in contact with a slot, which is separated by the leading edge and trailing edge of the slot extrusion die. The distance between the trailing edge and leading edge in the direction that the web is moving is about 0.005 inches, wherein a uniform chemical softening composition flow profile is achieved. The chemical softening composition is extruded between the leading edge and trailing edge of the slot die at a flow rate of about 2.2 milliliters per minute per inch. The chemical softening composition comes in contact with the web, which has a basis weight of about 22 pounds per 3000 square feet. The web and the chemical softening composition move across the trailing edge of the slot extrusion die; the trailing edge has a length of about 0.25 inches and the angle of web wrap about the trailing edge is about 5 degrees.

The web moves towards the winder with an open time of about 0.35 seconds after which the web containing the chemical softening composition is wound into a parent roll such that the side containing the chemical softening composition does not come in contact with the winder surface but rather comes in contact with the web surface that is on the winding parent roll.

Separately, the combination of the described web and the softening composition are evaluated for Drop Absorbency Time (DAT). The DAT value is about 2.5 seconds; therefore the ratio of open time to DAT is about 0.14 seconds.

The web is converted into a layered single-ply creped patterned densified tissue paper product with functionally sufficient of chemical softening composition on both sides of the web. The resulting treated tissue paper has an improved tactile sense of softness relative to the untreated control.

The table below illustrates the surface concentration of the chemical softness composition on the second side 52 relative to that on the first side 51 of the web 50.

Example 3

Example 3 is similar to Example 2, with the difference that the flow rate through the slot extrusion die is 5.1 milliliters per minute per inch.

The table below illustrates the surface concentration of the chemical softness composition on the second side 52 relative to that on the first side 51 of the web 50.

Example 4

Example 4 is similar to Example 2, with the difference that the flow rate through the slot extrusion die is 8.7 milliliters per minute per inch.

The table below illustrates the surface concentration of the chemical softener on the second side 52 relative to that on the first side 51.

Example 5

Example 4 is similar to Example 2, wherein the flow rate through the slot extrusion die is 5.8 milliliters per minute per inch and the basis weight of the web is about 24 pounds per 3000 square feet.

The table below illustrates that the surface concentration of the chemical softness composition on the second side 52 relative to that on the first side 51.

| | Quaternary Chemical Softening Concentration on Web (lb/ton) | Quaternary Chemical Softening Concentration on First Side (lb/ton) | Quaternary Chemical Softening Concentration on Second Side (lb/ton) | Ratio of First Side Quaternary Chemical Softening Concentration to that of Second Side Chemical Softening Concentration |
|---|---|---|---|---|
| Example 1 | 47 | 178 | 74 | Approx. 5:2 |
| Example 2 | 10 | 180 | 91 | Approx. 2:1 |
| Example 3 | 23 | 176 | 192 | Approx. 1:1 |
| Example 4 | 38 | 132 | 123 | Approx. 1:1 |
| Example 5 | 23 | 103 | 109 | Approx. 1:1 |

TEST METHODS

Surface Concentration of a Functional Chemical Additive Analysis

The surface concentration of the functional chemical additive 40 is determined by a lint rub testing, using a Sutherland Rub Tester. This tester uses a motor to rub a weighted felt five times over the stationary fibrous web 50. The felt is used to yield a portion of the abraded fiber from the fibrous web 50. Suitable quantitative analysis of the abraded fiber for content of the functional chemical additive 40 provides an indication of the concentration of that additive 40 residing on the surface of the fibrous web 50.

The method applies especially to toilet tissue or facial tissue products, but can be applied to any loosely bonded fibrous structure.

Prior to the lint rub testing, the samples to be tested should be conditioned according to Tappi Method #T4020M-88, incorporated herein by reference. Here, samples are preconditioned for 24 hours at a relative humidity level of from 10% to 35% and within a temperature range of from 22° C. to 40° C. After this preconditioning step is accomplished, samples should be conditioned for 24 hours at a relative humidity of from 48% to 52% and within a temperature range of from 22° C. to 24° C. The rub testing should also take place within the confines of the constant temperature and humidity room.

The Sutherland Rub Tester may be obtained from Testing Machines, Inc. (Amityville, N.Y., 11701). Portions of the fibrous web 50 to be tested are first prepared by removing and discarding any portion of the product that might have been abraded in handling, e.g. most typically on the outside of a toilet tissue roll. Specifically, for a single-ply toilet tissue product, three sections, each containing two sheets of a single-ply product, are removed and set on the bench-top. Each sample is then folded in half such that the folding crease is running along the transverse, or cross-machine, direction (CD), of the toilet tissue sample. For other types or shapes of fibrous web products, a size similar to toilet tissue sheets folded as directed may be used.

Then, a 30"×40" piece of Crescent #300 cardboard from Cordage Inc. (800 E. Ross Road, Cincinnati, Ohio, 45217) is provided. Using a paper cutter, six pieces of cardboard, each having dimensions of 2.5"×6" are cut. Two holes are punctured into each of the six cards by forcing the cardboard onto the hold down pins of the Sutherland Rub tester.

Then, each of the 2.5"×6" cardboard pieces is centered and carefully placed on top of the three previously folded samples. The 6" dimension of the cardboard should be running parallel to the longitudinal, or machine, direction (MD) of each of the tissue samples.

Fold one edge of the exposed portion of fibrous web sample onto the back of the cardboard. Secure this edge to the cardboard with adhesive tape available from 3M Inc. (¾wide Scotch Brand, St. Paul, Minn.). Carefully grasp the other over-hanging fibrous web edge and snugly fold it over onto the back of the cardboard. While maintaining a snug fit of the paper onto the board, tape this second edge to the back of the cardboard. Repeat this procedure for each sample.

Turn over each sample and tape the cross-directional edge of the tissue paper to the cardboard. Approximately one-half of the adhesive tape should contact the tissue paper while the other half is adhering to the cardboard. Repeat this procedure for each of the samples. If the sample breaks, tears, or becomes frayed at any time during the course of this sample-preparation procedure, discard the sample and make up a new sample with a new sample strip. There will now be three samples on cardboard.

For felt preparation, a 30×40" piece of Crescent #300 cardboard from Cordage Inc. (800 E. Ross Road, Cincinnati, Ohio, 45217) could be used. Using a paper cutter, cut out three pieces of cardboard of dimensions of 2.25"×7.25." Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut three pieces of black felt (F-55 or equivalent from New England Gasket, 550 Broad Street, Bristol, Conn. 06010) to the dimensions of 2.25"×8.5"×0.0625." Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of three of these felt/cardboard combinations.

The four-pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off. When not in use, the weight must be positioned such that the pads are not supporting the full weight of the weight. It is best to store the weight on its side.

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run five strokes by moving the pointer arm on the large dial to the "five" position setting. One stroke is a single and complete forward and reverse motion of the weight. The end of the rubbing block should be in the position closest to the operator at the beginning and at the end of each test.

Prepare a fibrous web on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the fibrous web sample and not the fibrous web sample itself. The felt must rest flat on the fibrous web sample and must be fully in contact with the fibrous web surface. Activate the tester by depressing the "push" button.

Keep a count of the number of strokes and observe and make a mental note of the starting and stopping position of the felt-covered weight in relationship to the sample. If the total number of strokes is five and if the end of the felt-covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until five strokes are counted and the end of the felt-covered weight closest to the operator is situated over the cardboard at the both the start and end of the test. During the actual testing of samples, observe and monitor the stroke count and the starting and stopping point of the felt-covered weight. Re-calibrate when necessary.

Measurements of samples are conducted in the following order. Place the fibrous web sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the fibrous web sample and not the fibrous web sample itself. The felt must rest flat on the fibrous web sample and must be fully in contact with the fibrous web surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and re-calibrate as directed above in the Sutherland Rub Tester Calibration section.

Remove the weight with the felt-covered cardboard. Inspect the sample. If torn, discard the felt and the sample and start over. If the sample is intact, remove the felt-covered cardboard from the weight and place it aside. Rub all remaining samples.

After all samples have been rubbed, recover a small amount of fiber from each felt. Typically, the fibers can be removed using a laboratory spatula. The amount of fibers recovered needs to be sufficient for the analytical method to be employed to assay the amount of functional chemical additive contained in the fiber sample. The actual amount which can be removed varies with the amount of fiber which has been abraded onto the felt, which in turn is related to the surface integrity of the fibrous web being measured. Take care not to introduce any particles from the felt into the fiber samples being recovered.

If the amount of fiber recoverable from each of the felts is insufficient to yield a fiber specimen, it is acceptable to repeat the rubbing of one or more sets of three new felts, combining fiber recovered from the two or more felts to form each of the three fiber specimens.

Once a sufficient amount of fiber, or the maximum recoverable fiber is removed from the felt, the felt should be disposed. Felt strips are not to be used again. Cardboards are used until they are bent, torn, limp, or no longer have a smooth surface. The process may be repeated on the two additional felts yielding a total of three fiber specimens.

The guideline for determining the number of sets of felt rubs which should be completed is to recover enough fiber such that the amount of functional chemical additive contained therein can be detected by a statistically valid analytical technique. One example of a functional chemical additive analysis is also detailed in this Test Methods section, the method for Softening Active Ingredient Level, which provides one method for determining the amount of quaternary softening compound on tissue or on fiber specimens.

Softening Active Ingredient Level

This method details one way of analyzing the amounts of softening active ingredients, described herein, that are retained on tissue paper webs or on samples of fiber recovered in the "Surface Concentration of a Functional Chemical Additive Analysis" method, described above. The "Softening Active Ingredient Level" method determines the amounts of quaternary softening active ingredients described herein that are retained on tissue paper webs or on fiber samples. This method is merely one example of a quantitative analysis method applicable to one particular class of chemical additives; the specific mention of this method is not meant to exclude other methods which may be useful for determining levels of these types of compounds or other additives which may be deposited on tissue paper or fiber specimens.

The following method is appropriate for determining the quantity of the preferred quaternary ammonium compounds (QAC) that may deposited by the method of the present invention. A standard anionic surfactant (sodium dodecylsulfate—NaDDS) solution is used to titrate the QAC using a dimidium bromide indicator.

The following methods are applicable for the preparation of the standard solutions used in this titration method.

Preparation of Dimidium Bromide Indicator

To a one-liter volumetric flask:

A) Add 500 milliliters of distilled water;

B) Add 40 ml. of dimidium bromide-disulphine blue indicator stock solution, available from Gallard-Schlesinger Industries, Inc. of Carle Place, N.Y.;

C) Add 40 ml of 5N $H_2SO_4$;

D) Fill flask to the mark with distilled water and mix.

Preparation of the NaDDS solution

To a one-liter volumetric flask:

A) Weigh 0.1154 grams of NaDDS available from Aldrich Chemical Co. of Milwaukee, Wis. as sodium dodecyl sulfate (ultra pure);

B) Fill the flask to mark with distilled water and mix to form a 0.0004N solution.

Method

1. On an analytical balance, weigh the specimen to be analyzed to the nearest 0.1 milligram. The exact size of the sample is not critical, but it should be sufficient to consume at least 1 ml of titrant in step 5 below. This may necessitate some trial and error. If one is titrating abraded fiber specimens and the amount of fiber is not sufficient, additional fiber can be collected from the felt, adding fiber from additional felts as necessary as described in the Surface Concentration of a Functional Chemical Additive Analysis method.

2. Place the sample in a glass cylinder having a volume of about 150 milliliters which contains a star magnetic stirrer. Using a graduated cylinder, add 20 milliliters of methylene chloride.

3. In a fume hood, place the cylinder on a hot plate turned to low heat. Bring the solvent to a full boil while stirring and using a graduated cylinder, and add 35 milliliters of dimidium bromide indicator solution.

4. While stirring at high speed, bring the methylene chloride to a full boil again. Turn off the heat, but continue to stir the sample. The QAC will complex with the indicator forming a blue colored compound in the methylene chloride layer.

5. Using a 10 ml. burette, titrate the sample with a solution of the anionic surfactant. This could be done by adding an aliquot of titrant and rapidly stirring for 30 seconds. Turn off the stir plate, allow the layers to separate, and check the intensity of the blue color. If the color is dark blue add about 0.3 milliliters of titrant, rapidly stir for 30 seconds and turn off stirrer. Again check the intensity of the blue color. Repeat if necessary with another 0.3 milliliters. When the blue color starts to become very faint, add the titrant dropwise between stirrings. The endpoint is the first sign of a slight pink color in the methylene chloride layer.

6. Record the volume of titrant used to the nearest 0.05 ml.

7. Calculate the amount of QAC in the product using the equation:

$$\frac{(millilitersNaDDS - X) \times Y \times 2}{SampleWt(\text{Grams})} = PoundsPerTonQAC,$$

where X is a blank correction obtained by titrating a specimen without the QAC of the present invention; and Y is the milligrams of QAC that 1.00 milliliters of NaDDS will titrate. For example, Y=0.254 for one particularly preferred QAC, i.e. diesterdi(touch-hydrogenated)tallow dimethyl ammonium chloride.

According to the present invention, the functionally sufficient amount of the chemical additive comprising a softening composition is preferably at least 20 pounds per ton (lb/ton), more preferably at least 50 lb/ton, and most preferably at least 90 lb/ton.

Drop Absorbency Time

Suitable Drop Absorbency Time (DAT) measurements may be made by using a micropipetter, such as an Oxford Benchmate, catalog number 8885-500903, by Oxford Labware, St. Louis Mo. The micropipetter is set to 10 micro-Liter (uL) used to apply droplets of a functional chemical additive 40 to the tissue surface.

In view of the small size of the droplets and relatively short time span normally observed using this method, the method is facilitated by using a video camera, such as a Panasonic WV—CL300 employing a Navitron TV Zoom 7000 with an 18–108mm Zoom Lens, to record an image of the droplet. Recording at a minimum of 60 frames per second is recommended, provided drop absorbency times (DAT) are not below about 0.5 seconds. Drop absorbency times which measure below 0.5 seconds require faster recording, while measurements of DAT which result in much higher values may allow use of fewer frames per second, as will be recognized by those skilled in the art. The frame frequency is to be selected such that review of the event frame-by-frame accurately determines the time elapsed between contact of the droplet with the surface of the tissue and the time at which the droplet is completely absorbed into the fibrous web 50. It is recognized that the droplet volume of the functional chemical additive 40 applied by this method can vary—since the amount of functional chemical additive 40 which can be drawn into the micropipetter and discharged through the tip by action of the plunger is determined by the fluid characteristics, particularly viscosity and surface tension.

In order to determine the Drop Absorbency Time, the micropipetter is filled with a supply of the functional chemical additive 40 for which the measurement is desired and the fibrous web 50 is positioned to facilitate receiving droplets of the additive. The orientation of the fibrous web should be flat (restraint by taping to a rigid surface is recommended), and the fibrous web should be orientated with the first side 51 exposed—in order to receive the droplets on the appropriate side as is intended by the process of the present invention. The micropipetter is poised above the fibrous web surface and the plunger is depressed completely, forming a droplet of the additive 40 at the tip of the pipetter. The droplet is brought into contact with the first surface 51 of the fibrous web 50 immediately to initiate the absorption.

The Drop Absorbency Time is calculated by dividing the frame count for absorption by the number of frames per second. The frame count for absorption is the number of frames elapsed between contact of the droplet with the surface 51 of the fibrous web 50 and complete absorption into the surface 51 as determined by counting while the VCR replay is proceeding in slow motion. Inventors have found that acceptably repeatable values can be determined by beginning counting with the first frame after which fluid-web contact occurs and continuing counting, including the first frame which shows no discernible fluid on the first surface 51 of the fibrous web 50. Note that the first surface 51 may continue to appear "wetted" for a much longer period, and during such period the chemical additive 40 may still be in a transferable condition, as defined herein. The Drop Absorbency Time is not intended to determine absolute time periods for maintaining the additive in a transferable condition, rather it is intended to correlate with the amount of time that the chemical additive 40 is maintained in a transferable condition.

According to the present invention, a ratio TO/DAT of an open time (TO) to a drop absorbency time (DAT) is preferably less than about 3.0, more preferably less than about 1.0, and most preferably less than about 0.5.

Tissue Density

As used herein, the density of the tissue paper is the average density calculated as the basis weight of that paper divided by the caliper, with the appropriate unit conversions incorporated therein. Caliper of the tissue paper, as used herein, is the thickness of the paper when subjected to a compressive load of 95 gram per square inch ($g/in^2$) (or 15.5 $g/cm^2$).

Panel Softness of Tissue Papers

Ideally, prior to softness testing, the paper samples to be tested should be conditioned according to TAPPI Method #T4020M-88, incorporated herein by reference. Preferably, samples are preconditioned for 24 hours at relative humidity of from 10% to 35% and within a temperature range of from 22° C. to 40° C. After this preconditioning step, samples should be conditioned for 24 hours at a relative humidity of from 48% to 52% and within a temperature range of from 22° C. to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactilely perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Strength of Tissue Papers

Dry Tensile Strength

This method is intended for use on finished paper products, reel samples, and unconverted stocks. The tensile strength of such products may be determined on one inch wide strips of sample using a Thwing-Albert Intellect 11

Standard Tensile Tester (Thwing-Albert Instrument Co of Philadelphia, Pa.).

Sample Conditioning and Preparation

Prior to tensile testing, the paper samples to be tested should be conditioned according to TAPPI Method #T4020M-88,incorporated herein by reference. All plastic and paper board packaging materials must be carefully removed from the paper samples prior to testing. The paper samples should be conditioned for at least 2 hours at a relative humidity of from 48% to 52% and within a temperature range of from 22° C. to 24° C. Sample preparation and all aspects of the tensile testing should also take place within the confines of the constant temperature and humidity room.

For finished product, discard any damaged product. Next, remove five strips of four usable units (also termed herein as "sheets") and stack one on top to the other to form a long stack with the perforations between the sheets coincident. Identify sheets 1 and 3 for machine direction tensile measurements and sheets 2 and 4 for cross-machine direction tensile measurements. (Machine direction MD is perpendicular to the cross-machine direction CD). Next, cut through the perforation line using a paper cutter (JDC-1-10 or JDC-1-12 with safety shield from Thwing-Albert Instrument Co. of Philadelphia, Pa.) to make 4 separate stocks. Make sure stacks 1 and 3 are still identified for machine direction testing and stacks 2 and 4 are identified for cross-machine direction testing.

Cut two 1-inch wide strips in the machine direction from stacks 1 and 3. Cut two 1-inch wide strips in the cross direction from stacks 2 and 4. There are now four 1-inch wide strips for machine direction tensile testing and four 1-inch wide strips for cross direction tensile testing. For these finished product samples, all eight 1-inch wide strips are five usable units thick.

For unconverted stock and/or reel samples, cut a 15-inch by 15-inch sample which is 8-plies thick from a region of interest of the sample, using a paper cutter (JDC-1-10 or JDC-1-12 with safety shield from Thwing-Albert Instrument Co of Philadelphia, Pa.). Make sure one 15-inch cut runs parallel to the machine direction while the other runs parallel to the cross-machine direction. Make sure the sample is conditioned for at least 2 hours at a relative humidity of from 48% to 52% and within a temperature range of from 22° C. to 24° C. Sample preparation and all aspects of the tensile testing should also take place within the confines of the constant temperature and humidity room.

From this preconditioned 15-inch by 15-inch sample which is 8-plies thick, cut four strips having dimensions 1 inch by 7 inch with the long 7-inch dimension running parallel to the machine direction. Note these samples as machine direction reel or unconverted stock samples. Cut an additional four 1-inch by 7-inch strips with the long 7-inch dimension running parallel to the cross-machine direction. Note these samples as cross-machine direction reel or unconverted stock samples. Make sure all previous cuts are made using a paper cutter (JDC-1-10 or JDC-1-12 with safety shield from Thwing-Albert Instrument Co. of Philadelphia, Pa.). There are now a total of eight samples: four 1-inch by 7-inch strips which are 8-plies thick with the 7-inch dimension running parallel to the machine direction, and four 1-inch by 7-inch strips which are 8-plies thick with the 7-inch dimension running parallel to the cross-machine direction.

Operation of Tensile Tester

For the actual measurement of the tensile strength, use a Thwing-Albert Intellect II Standard Tensile Tester (Thwing-Albert Instrument Co. of Philadelphia, Pa.). Insert the flat face clamps into the unit and calibrate the tester according to the instructions given in the operation manual of the Thwing-Albert Intellect II. Set the instrument cross-head speed to 4.00 in/min and the 1st and 2nd gauge lengths to 2.00 inches. The break sensitivity should be set to 20.0 grams, the sample width should be set to 1.00", and the sample thickness should be set at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

Calculations

For the four machine-directional 1-inch wide finished product strips, sum the four individual recorded tensile readings. Divide this sum by the number of strips tested. This number should normally be four. Also divide the sum of recorded tensiles by the number of usable units per tensile strip. This is normally five for both 1-ply and 2-ply products.

Repeat this calculation for the finished cross-machine directional product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally eight.

Repeat this calculation for the cross direction unconverted or reel sample paper strips.

All results are in units of grams/inch.

Viscosity

Overview

Viscosity is measured at a shear rate of 100 ($s^{-1}$) using a rotational viscometer. The samples are subjected to a linear stress sweep, which applies a range of stresses, each at a constant amplitude.

Apparatus

Viscometer: Dynamic Stress Rheometer Model $SR_{500}$ which is available from Rheometrics Scientific, Inc. of Piscatawy, N.J.

Sample Plates: 25 mm parallel insulated plates are used.

Setup

Gap: 0.5 mm

Sample Temperature: 20° C.

Sample Volume: at least 0.2455 $cm^3$

Initial Shear Stress: 10 dynes/$cm^2$

Final Shear Stress: 1,000 dynes/$cm^2$

Stress Increment: 25 dynes/$cm^2$ applied every 20 seconds

Method

Place the sample on the sample plate with the gap open. Close the gap and operate the rheometer according to the manufacturer's instructions to measure viscosity as a function of shear stress between the initial shear stress and the final shear stress using the stress increment defined above.

Results and Calculation

The resulting graphs plot log shear rate ($s^{-1}$) on the x-axis, log viscosity, Poise (P) on the left y-axis, and stress (dynes/$cm^2$) on the right y-axis. Viscosity values are read at a shear rate of 100 ($s^{-1}$). The values for viscosity are converted from P to centipoise (cP) by multiplying by 100.

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for applying a chemical additive to a fibrous web, the process comprising the steps of:

(a) providing a fibrous web having a first side and a second side opposite to the first side;

(b) providing a chemical additive;

(c) depositing the chemical additive only to the first side of the fibrous web;

(d) maintaining the chemical additive deposited onto the first side of the web in a transferable condition such that a ratio of an open time to a drop absorbency time less than 3.0;

(e) causing the first side of the fibrous web to contact the second side of the fibrous web thereby partially transferring the chemical additive from the first side to the second side of the fibrous web such that both the first side and the second side of the fibrous web comprise the chemical additive in a functionally sufficient amount.

2. The process according to claim 1, wherein the step (e) comprises transferal of the chemical additive from a first position on the first side of the fibrous web to a second position on the second side of the fibrous web, the second position being off-set from the first position relative to a plane of the web.

3. The process according to claim 2, further comprising a step of continuously moving the fibrous web in a machine direction.

4. The process according to claim 3, wherein the step (e) comprises continuously winding the fibrous web into a roll.

5. The process according to claim 4, wherein the second position on the second side of the fibrous web is off-set in the machine direction from the first position on the first side of the fibrous web.

6. The process according to claim 5, wherein in the step (e) the amount of the chemical additive transferred from the first side of the fibrous web to the second side of the fibrous web is such that a ratio R of a surface concentration SC2 of the chemical additive on the second side to a surface concentration SC1 of the chemical additive on the first side is at least 1:4.

7. The process according to claim 6, wherein the ratio R is at least 1:2.

8. The process according to claim 7, wherein the ratio R is about 1:1.

9. The process according to claim 6, wherein the step (c) comprises extrusion coating, spray coating, print coating or any combination thereof.

10. The process according to claim 1, wherein in the step (b) the chemical additive is selected from the group consisting of softeners, emulsions, emollients, lotions, topical medicines, soaps, anti-microbial and anti-bacterial agents, moisturizers, coatings, inks and dies, strength additives, absorbency additives, binders, opacity agents, fillers, and combinations thereof.

11. The process according to claim 10, wherein the chemical additive is a chemical softener selected from the group consisting of lubricants, plasticizers, cationic debonders, noncationic debonders, and mixtures thereof.

12. The process according to claim 11, wherein in the step (e) the functionally sufficient amount of the chemical additive is at least 20 pounds per short ton.

13. The process according to claim 12, wherein the functionally sufficient amount of the chemical additive is at least 50 pounds per short ton.

14. The process according to claim 13, wherein the functionally sufficient amount of the chemical additive is at least 90 pounds per short ton.

15. The process according to claim 10, wherein the chemical additive is a strength additive selected from the group consisting of permanent wet-strength resins, temporary wet-strength resins, dry-strength resins, and mixtures thereof.

16. The process according to claim 10, wherein the chemical additive is an absorbency additive selected from the group consisting of polyethoxylates, alkylethoxylated esters, alkylethoxylated alcohols, alkylpolyethoxylated nonylphenols, and mixtures thereof.

17. The process according to claim 1, wherein the ratio of the open time to the drop absorbency time is less than about 1.0.

18. The process according to claim 17, wherein the ratio of the open time to the drop absorbency time is less than about 0.5.

19. A process for applying a chemical additive to a fibrous web, the process comprising the steps of:

(a) providing a fibrous web having a first side and a second side opposite to the first side;

(b) providing a softening composition selected from the group consisting of lubricants, plasticizers, cationic debonders, noncationic debonders, and mixtures thereof;

(c) depositing the softening composition only to the first side of the fibrous web in the amount of at least 0.05 gram of the softening composition per square meter of the web;

(d) maintaining the softening composition disposed on the first side of the fibrous web in a transferable condition such that a ratio of an open time to a drop absorbency time less than 3.0;

(e) continuously winding the fibrous web into a roll thereby causing the first side of the fibrous web to contact the second side of the fibrous web such that the softening composition disposed on the first side is partially transferred therefrom to the second side of the web, wherein the amount of the softening composition transferred from the first side to the second side of the fibrous web is such that a ratio of a surface concentration of the chemical additive on the second side to a surface concentration of the chemical additive on the first side is at least 1:4.

20. The process according to claim 19, wherein in the step (a) at least the first side of the fibrous web comprises a first region and a second region, the first region being raised above the second region.

21. The process according to claim 20, wherein the step (c) comprises depositing the softening composition non-compressively to the first region of the first side of the fibrous web.

22. The process according to claim 21 wherein in the step (a) the fibrous web comprises a pattern-densified structure, the first region having a first density and the second region having a second density different from the first density.

23. The process according to claim 22, wherein the first density is lower than the second density.

24. The process according to claim 19, wherein the step (c) is conducted during the papermaking process.

25. The product according to claim 19, wherein the chemical softening composition comprises a quaternary ammonium compound.

* * * * *